US008800614B2

(12) United States Patent
Loudenslager et al.

(10) Patent No.: US 8,800,614 B2
(45) Date of Patent: Aug. 12, 2014

(54) GOLF CLUB HEAD COVERS WITH A STRAP AND METHODS TO MANUFACTURE GOLF CLUB HEAD COVERS

(75) Inventors: John H. Loudenslager, Phoenix, AZ (US); David D. Jones, Anthem, AZ (US); Kevin W. Flaherty, Phoenix, AZ (US); James Martell, Bettendorf, IA (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 201 days.

(21) Appl. No.: 13/196,392

(22) Filed: Aug. 2, 2011

(65) Prior Publication Data

US 2012/0255659 A1 Oct. 11, 2012

Related U.S. Application Data

(60) Provisional application No. 61/473,603, filed on Apr. 8, 2011.

(51) Int. Cl.
*A63B 55/00* (2006.01)

(52) U.S. Cl.
CPC ..... *A63B 55/007* (2013.01)
USPC ..... 150/160; 206/315.2; 206/315.4; 206/315.11; 150/154; D21/754

(58) Field of Classification Search
CPC ..... A63B 55/007; A63B 2209/10; A63B 2209/08; A63B 47/04
USPC ..... 150/154, 160; 206/315.2, 315.4, 206/315.11; D21/754
See application file for complete search history.

(56) References Cited

U.S. PATENT DOCUMENTS

| | | | | | |
|---|---|---|---|---|---|
| 2,035,529 | A | * | 3/1936 | Bucklin | 150/160 |
| 2,417,336 | A | * | 3/1947 | Whitehead | 150/160 |
| 2,508,525 | A | * | 5/1950 | Le Fevre | 150/160 |
| 2,526,983 | A | * | 10/1950 | Wait | 198/429 |
| 2,532,195 | A | * | 11/1950 | Rosenow et al. | 150/160 |
| 2,879,819 | A | * | 3/1959 | Turnbull | 206/315.4 |
| 3,023,795 | A | * | 3/1962 | Denkert | 150/160 |
| 3,051,210 | A | * | 8/1962 | Mesinger | 150/160 |
| 3,133,577 | A | * | 5/1964 | Bellevue, Sr. | 150/160 |
| 3,145,749 | A | * | 8/1964 | Rosenow | 150/160 |
| 3,294,138 | A | * | 12/1966 | Pawly | 150/160 |
| 3,295,236 | A | * | 1/1967 | Wishnia | 40/642.02 |
| 3,821,976 | A | | 7/1974 | Smith et al. | |
| 5,168,909 | A | | 12/1992 | Joyner, Jr. | |
| 5,295,268 | A | | 3/1994 | Pociask | |
| 5,345,987 | A | | 9/1994 | Hagar | |
| 5,403,009 | A | | 4/1995 | Gleason, Jr. | |
| D374,051 | S | | 9/1996 | Sheppard, Jr. | |
| D421,780 | S | | 3/2000 | Whitesides | |
| 6,820,665 | B2 | | 11/2004 | Bradshaw | |

(Continued)

OTHER PUBLICATIONS

Taylormade RBZ Fairway Wood Headcover—fits R11S, R11, R9, http://www.ebay.com, Sep. 11, 2013.

(Continued)

*Primary Examiner* — Fenn Mathew
*Assistant Examiner* — Cynthia Collado

(57) ABSTRACT

Embodiments of club head covers having a pull strap and methods to manufacture club head covers are generally described herein. Other embodiments of club head covers having a pull strap may be described and claimed.

11 Claims, 26 Drawing Sheets

(56) References Cited

U.S. PATENT DOCUMENTS

| | | | | |
|---|---|---|---|---|
| D561,857 | S | 2/2008 | Noyes et al. | |
| D606,604 | S | 12/2009 | Norris | |
| 7,686,047 | B2 | 3/2010 | Hooley | |
| 7,686,048 | B1 | 3/2010 | Bradshaw | |
| 7,857,023 | B2 | 12/2010 | Hooley | |
| 2003/0056866 | A1 | 3/2003 | Sheppard, Jr. | |
| 2007/0102081 | A1 | 5/2007 | Hooley | |
| 2008/0105343 | A1* | 5/2008 | Noyes et al. | 150/160 |
| 2011/0056600 | A1 | 3/2011 | Hooley | |

OTHER PUBLICATIONS

Search report issued in Canadian Patent Application No. 2,770,935, issued Aug. 12, 2013.

* cited by examiner

GOLF CLUB HEAD COVERS WITH A STRAP AND METHODS TO MANUFACTURE GOLF CLUB HEAD COVERS

CROSS-REFERENCE TO RELATED APPLICATIONS

This is a non-provisional and claims priority to U.S. Provisional Patent Application Ser. No. 61/473,603 filed on Apr. 8, 2011, which is herein incorporated by reference in its entirety.

FIELD

The present disclosure relates to club head covers, and in particular to club head covers having a pull strap for removal of the golf club head cover from a golf club head.

BACKGROUND

Proper care of golf clubs is required both to maximize their usable life and to maintain their performance. An important aspect of proper care includes protecting golf club heads from damage due to impact with other golf club heads or exposure to environmental elements when the clubs are not in use. As such, club head covers are widely used for many types of golf clubs, such as putters and wood-type golf clubs. Many existing club head covers are usually removed by gripping them anywhere the individual is able to grasp the club head cover, which usually involves trying to pinch or squeeze excess material of the club head cover to remove it from the golf club head; however such a technique can be cumbersome. Although there are club head covers having a strap to assist in removing the golf club head, such straps are thin and of constant width which can be difficult for the individual to grasp or handle appropriately to efficiently remove the club head cover. In addition, the force required to be applied to such thin straps to remove the club head cover from the golf club can also lead to the material of the club head cover being overly stretched and elongated after repeated removal. This action can also bend and apply stress to the shaft of the golf club as the individual attempts remove the club head cover from the golf club head. Moreover, thin pull straps may also become damaged over time due to constant use that can produce stress points, which can cause the pull strap to break over time.

BRIEF DESCRIPTION OF THE DRAWINGS

Corresponding reference characters indicate corresponding elements among the various views of the drawings. The headings used in the figures should not be interpreted to limit the scope of the claims.

DETAILED DESCRIPTION

Figure 1:
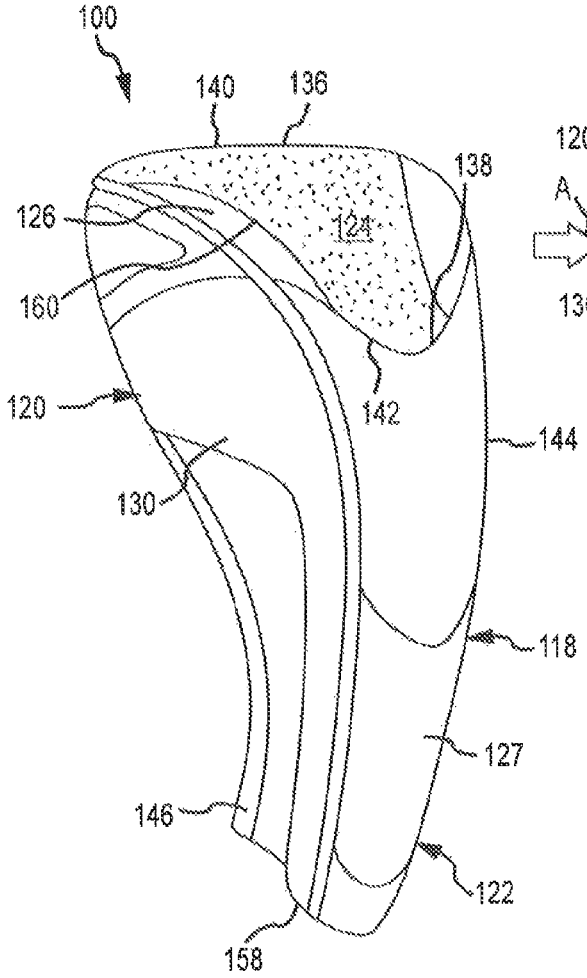
FIG. 1 is a perspective view of an embodiment of a club head cover showing a sleeve portion and a head portion that includes a pull strap.

As described herein, a club head cover having an improved pull strap and methods of manufacturing such a club head cover is configured to permit easy removal of the club head cover from a golf club head.

Proper care of golf clubs is required both to maximize their usable life and to maintain their performance. An important aspect of proper care includes protecting golf club heads from damage due to impact with other golf club heads or exposure to environmental elements when not is use. As such, club head covers are widely used for many types of golf clubs, such as putters and wood-type golf clubs. Many existing club head covers are usually removed by gripping them anywhere the individual is able to grasp the club head cover, which usually involves trying to pinch or squeeze excess material of the club head cover in order to remove it from the golf club head. Although there are club head covers having a strap to assist in removing the golf club head, such straps are usually thin and of constant width which can make it difficult for the individual to grasp or handle the club head cover appropriately to efficiently remove the club head cover from the golf club head. The excessive force required to be applied to such thin straps in order to remove the club head cover from the golf club head can also lead to the material of the club head cover being overly stretched and elongated after repeated removal which can cause it to loosely fit or droop when engaged to the golf club head.

Referring to the drawings, embodiments of the club head cover are illustrated and generally indicated as 100, 200, 300, 400, 500, 600, 700, 800, 900, 1100, 1200, 1300, 1400, 1500, 1600, 1700 and 1800 in FIGS. 1-39. In general, one embodiment of the club head cover shown in FIGS. 1-6 of the club head cover, designated 100, may include an elongated flexible body 118 defining a head portion 120 and a sleeve portion 122 configured to cover a golf club 112. In one embodiment, the head portion 120 and the sleeve portion 122 may form an L-shaped configuration. In some embodiments, the head portion 120 defines a hollow compartment 134 configured to receive and completely cover a golf club head 114 of the golf club 112, while the sleeve portion 122 defines a sleeve conduit 162 in communication with the hollow compartment 134 in which the sleeve conduit 162 defines an open end 158. The open end 158 allows passage of the golf club head 114 through the sleeve conduit 162 and permits a portion of the shaft 116 of the golf club 112 to be covered by the sleeve portion 122 once the golf club head 114 is fully disposed inside the hollow compartment 134. In addition, the hollow sleeve portion 122 defines a distal portion 144 formed adjacent the head portion 120 and a proximal portion 146 located farthest away from the head portion 120 of the flexible body 118. In some embodiments, the golf club 112 may be associated with at least one of a driver-type golf club, a wood-type golf club, an iron-type golf club, a hybrid-type golf club, or a putter-type golf club; however, the apparatus, articles of manufacture, and methods described herein are not limited in this regard.

Figure 5:
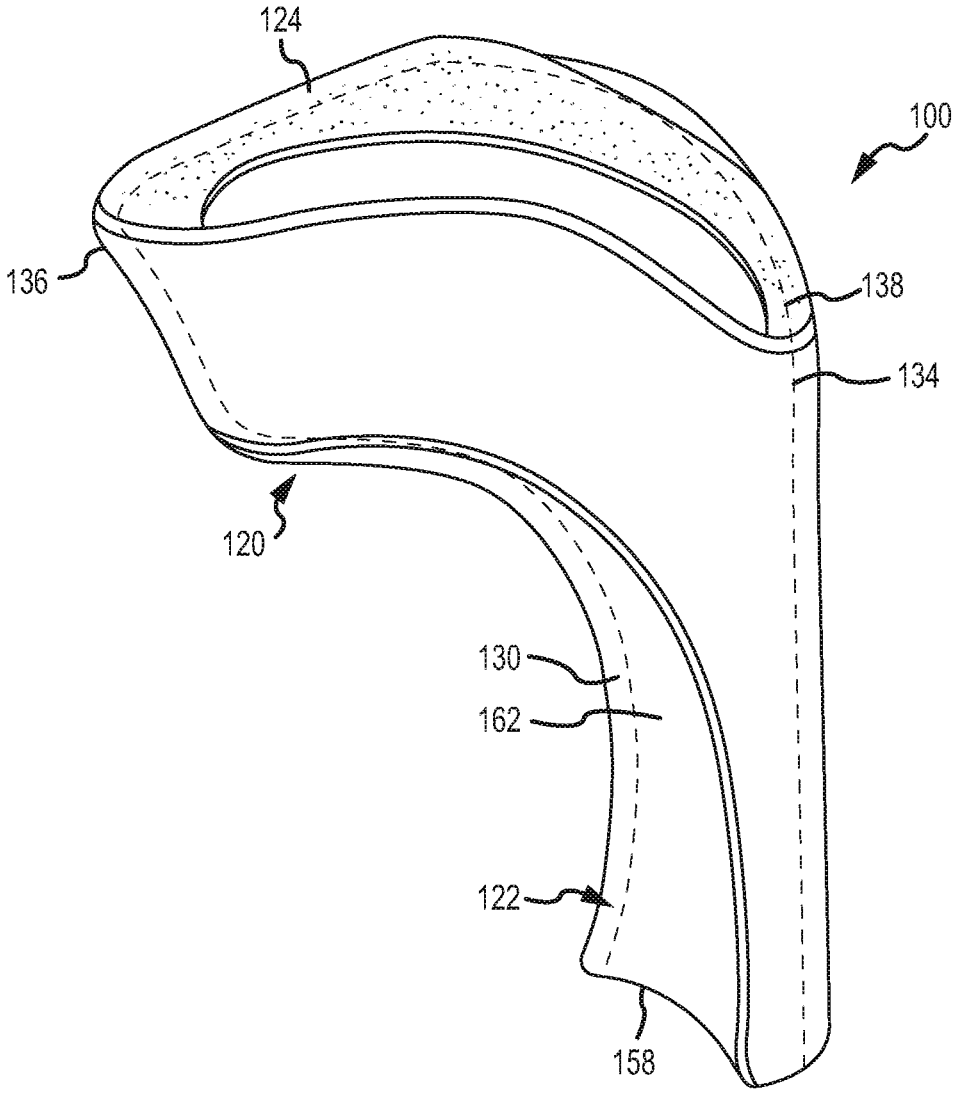
FIG. 5 is a side view of the club head cover illustrating the hollow compartment and sleeve conduit in phantom.
Figure 6:
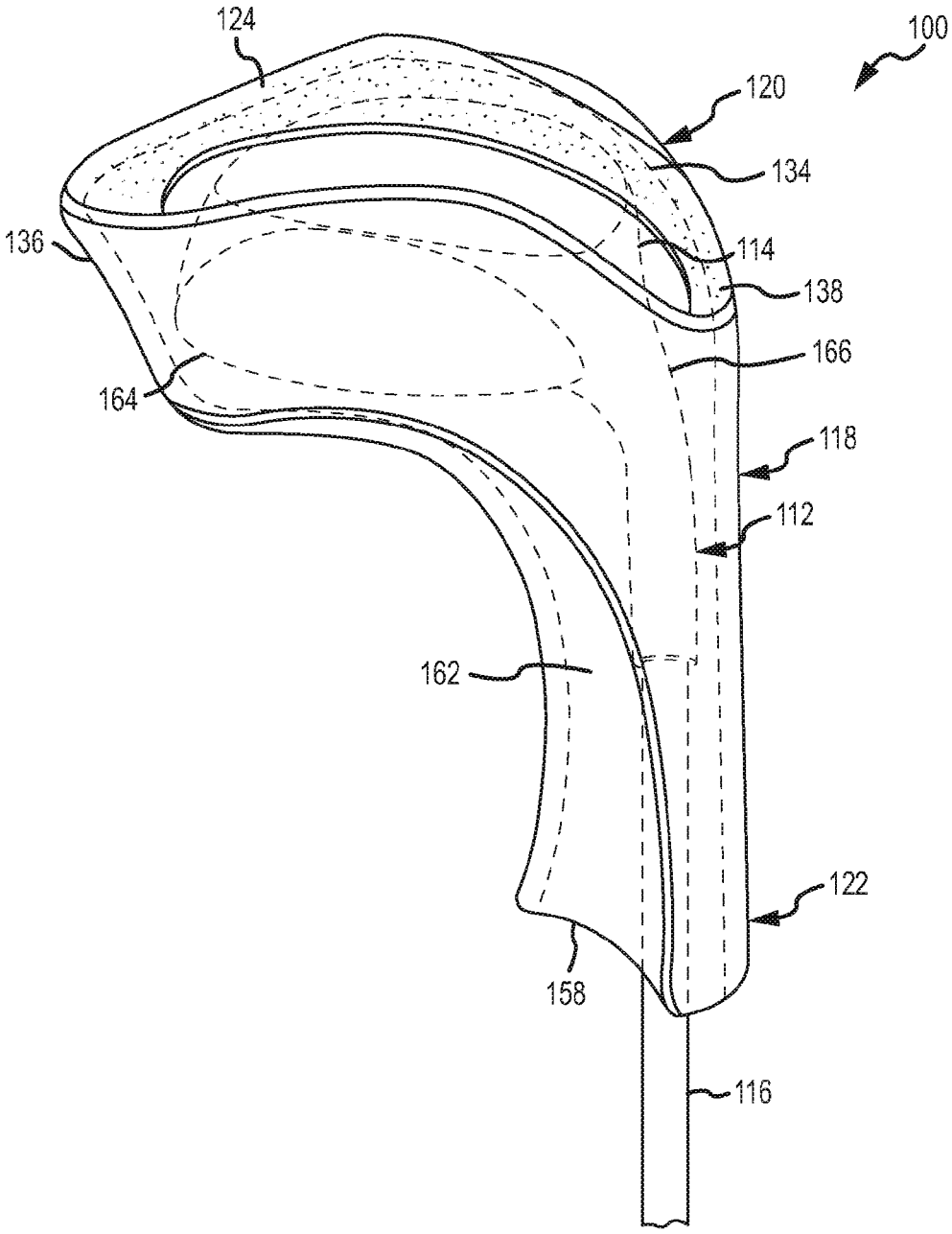
FIG. 6 is a side view of the club head cover engaged to a golf club shown in phantom.
Figure 7:
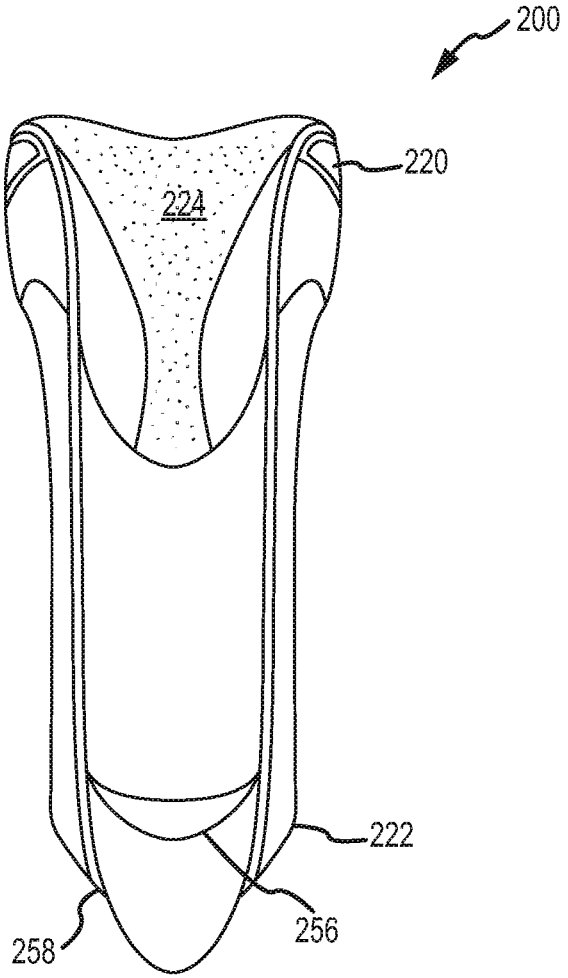
FIG. 7 is a rear view of the club head cover showing an integral loop of the sleeve portion.
Figure 8:
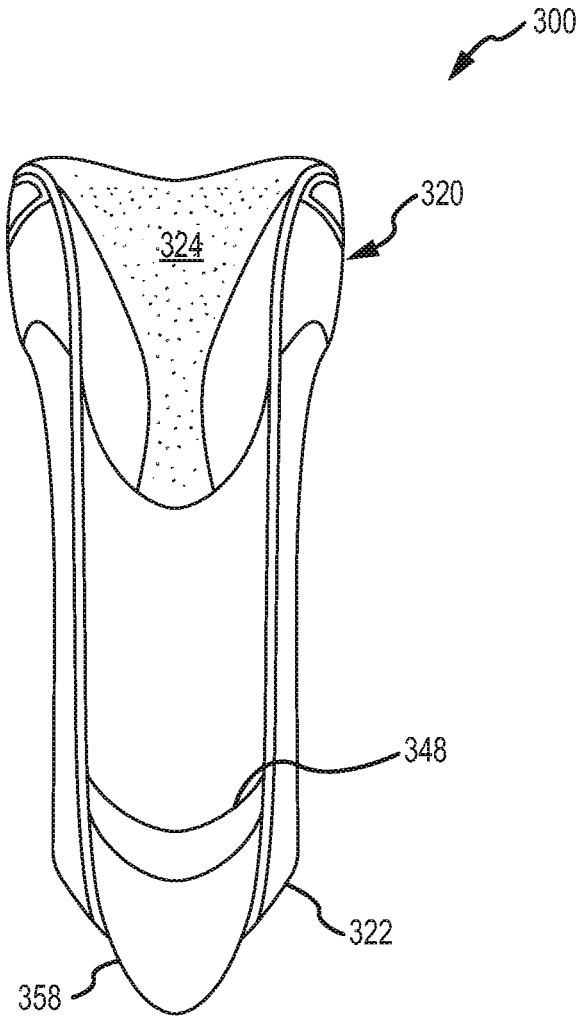
FIG. 8 is a rear view of the club head cover showing a tab of the sleeve portion.

Referring to FIGS. 5 and 6, the golf club head 114 defines a toe portion 164 and a heel portion 166, and the head portion 120 defines a first head end 136 and a second head end 138. The toe portion 164 and the heel portion 166 fit within the hollow compartment 134 and correspond to the first head end 136 and the second head end 138, respectively when the golf club head 114 is disposed inside the hollow compartment 134. In some embodiments, the hollow compartment 134 of the head portion 120 increases in size from the second head end 138 to the first head end 136 of the head portion 120. In one embodiment, the hollow compartment 134 is wider at or proximate to the first head end 136 than at or proximate to the second head end 138. In addition, a pull strap 124 may be attached or integral with the head portion 120 and is configured to allow an individual to remove the club head cover 100 from the golf club head 114 as shall be discussed in greater detail below.

Figure 4:
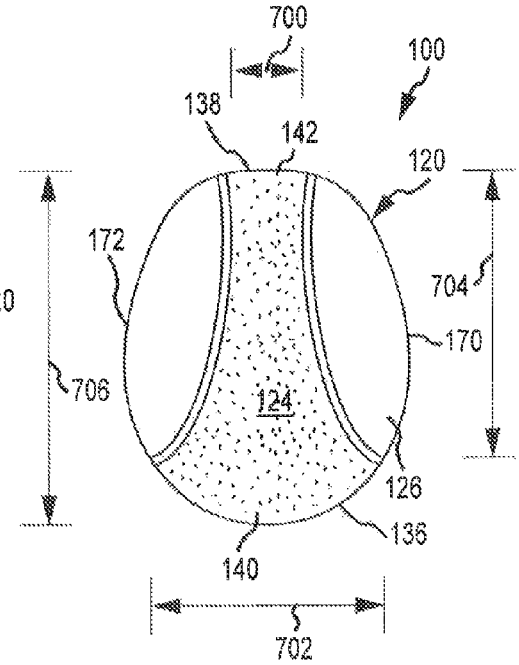
FIG. 4 is a top view of the club head cover illustrating a first orientation of the pull strap.

Referring to FIGS. 1-5, the flexible body 118 of the club head cover 100 further defines a top wall 126, a rear wall 127, a front wall 128, a first side wall 130, and a second side wall 132 that collectively define the hollow compartment 134 and the sleeve conduit 162 of the club head cover 100. The pull strap 124 may include first strap end 140 and a second strap end 142 in which the first strap end 140 has a width wider than the second strap end 142 of the pull strap 124. As shown in FIG. 4, one embodiment of the second strap end 142 of pull strap 124 has a width 700 of about 2.25 inches, while the first strap end 140 of pull strap 124 has a width 702 of about 5 inches. In addition, the pull strap 124 may have an inner length 704 of about 4.75 inches and an outer length 706 of about 7 inches. In some embodiments, width 700 may be between 1.25 to 3 inches, width 702 may be between 4 to 6 inches, inner length 704 may be between 3.0 to 5.5 inches, and outer length 706 may be between 5 to 8 inches. The apparatus, articles of manufacture, and methods described herein are not limited in this regard.

In some embodiments, the pull strap 124 may be attached to the top wall 126 of the head portion 120 so that a channel 160 is defined between the pull strap 124 and the top wall 126 of the head portion 120. As shown in FIG. 4, the head portion 120 may be defined by first head end 136, second head end 138, third head end 170 and fourth head end 172. Besides the top portion 164 and the heel portion 166, the golf club head 114 also defines a back portion and a face portion. The back portion and the face portion fit within the hollow compartment 134 and correspond to the third head end 170 and the fourth head end 172, respectively when the golf club head 114 is disposed inside the hollow compartment 134.

In one embodiment, the pull strap 124 may be attached to the top wall 126 of the head portion 120 in a first orientation so that the first strap end 140 of the pull strap 124 is attached or integral with the first head end 136 of the head portion 120 and the second strap end 142 of the pull strap 124 is attached or integral with the second head end 138 of the head portion 120 as illustrated in FIG. 4. The first strap end 140 is wider than the second strap end 142 so that the pull strap 124 tapers from the first head end 136 to the second head end 138. Referring back to FIG. 6, for example, the hollow compartment 134 at the first head end 136 of the head portion 120 may cover the toe portion 164 of the golf club head 114, whereas the hollow compartment 134 at or proximate to the second head end 138 of the head portion 120 may cover the heel portion 166 of the golf club head 114. In this orientation, an individual grasping the pull strap 124 can apply a greater upward force to the heel portion 166 of the golf club head 114 than the toe portion 164 of the golf club head 114. However, in other embodiments, the pull strap 124 may be oriented in different orientations.

Figure 12:
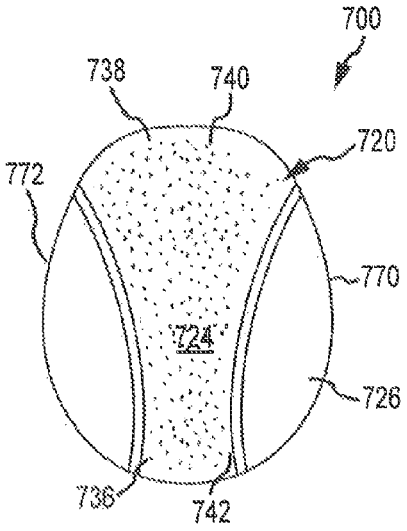
FIG. 12 is a top view of the club head cover showing a second orientation of the pull strap.

Referring to FIG. 12, one embodiment of the club head cover, designated 700, may include a head portion 720 that defines a first head end 736, a second head end 738, a third head end 770 and a fourth head end 772. In contrast to pull strap 124, a pull strap, designated 724, may be attached or integral with the head portion 720 in a second orientation so that the first strap end 740 of the pull strap 724 is attached or integral with the second head end 738 and the second strap end 742 of the pull strap 724 is attached or integral with the first head end 736. In contrast to pull strap 124 of FIG. 4, the first strap end 740 of FIG. 12 is wider than the second strap end 742 so that the pull strap 724 tapers from the second head end 738 to the first head end 736. Pull strap 124 of FIG. 4 tapers from the first head end 136 to the second head end 138. As such, pull strap 724 is attached to the head portion 720 in an opposite orientation relative to pull strap 124. As shown in FIG. 6, for example, the hollow compartment 134 at the first head end 736 may cover the toe portion 164 of the golf club head 114, whereas the hollow compartment 134 at or proximate to the second head end 738 may cover the heel portion 166 of the golf club head 114. In this orientation, an individual grasping the pull strap 724 can apply a greater upward force to the heel portion 166 of the golf club head 114 than the toe portion 164 of the golf club head 114. As shown, the pull strap 724 extends longitudinally or length-wise across the head portion 120.

Figure 13:
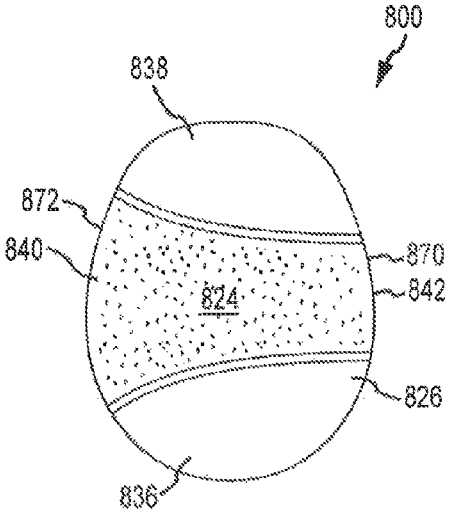
FIG. 13 is a top view of the club head cover showing a third orientation of the pull strap.

Referring to FIG. 13, one embodiment of the club head cover, designated 800, may include a head portion 820 that defines a first head end 836, a second head end 838, a third head end 870 and a fourth head end 872. In contrast to the pull strap 724 shown in FIG. 12, a pull strap, designated 824, may be attached or integral with the head portion 820 in a third orientation that is in transverse orientation relative to either the pull strap 124 or pull strap 724 so that the first strap end 840 of the pull strap 824 is attached or integral with the fourth head end 872 and the second strap end 842 of the pull strap 824 is attached or integral with the third head end 870. The first strap end 840 of FIG. 13 is wider than the second strap end 842 so that the pull strap 824 tapers from the fourth head end 872 to the third head end 870. This is analogous to rotating the strap 124 of FIG. 4 clockwise 90° so that the first end strap 140 is now at the fourth head end 172 and the second strap end 142 is at the third head end 170. In this orientation, an individual grasping the pull strap 824 can apply a greater upward force to the back portion of the golf club head 114 than the face portion of the golf club head 114 when removing the club head cover 800. In further contrast to the embodiment shown in FIG. 12, the pull strap 824 may be relatively shorter than the pull strap 724 as the pull strap 824 extends substantially along length 702. As shown, the pull strap 824 extends in a latitudinal direction or width-wise across the head portion 820. In one aspect, the pull strap 824 is configured for grasping by right-handed individuals.

Figure 14:
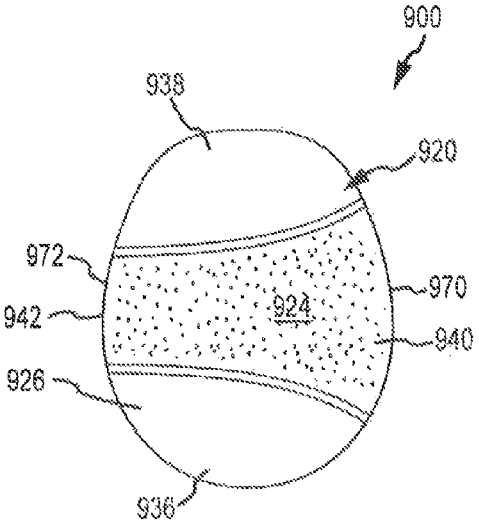
FIG. 14 is a top view of the club head cover showing a fourth orientation of the pull strap.

Referring to FIG. 14, one embodiment of the club head cover, designated 900, may include a head portion 920 that defines a first head end 936, a second head end 938, a third head end 970 and a fourth head end 972. In contrast to the pull strap 824 of FIG. 13, a pull strap, designated 924, may be attached or integral with the head portion 920 in a fourth orientation that is opposite to the orientation of pull strap 824 so that the first strap end 940 of the pull strap 924 is attached or integral with the third head end 970 and the second strap end 942 of the pull strap 924 is attached or integral with the fourth head end 972. The first strap end 940 of FIG. 14 is wider than the second strap end 942 so that the pull strap 924 tapers from the third head end 970 to the fourth head end 972. This is analogous to rotating the pull strap 124 of FIG. 4 counterclockwise 90° so that the first end strap 140 is now at the fourth head end 172 and the second end strap 142 is attached to the third head end 170. In this orientation, an individual grasping the pull strap 924 can apply a greater upward force to the face portion of the golf club head 114 than the back portion of the golf club head 114 when removing the club head cover 900. In one aspect, the pull strap 924 may have substantially the same length 702 as pull strap 824. In addition, the pull strap 924 is configured for grasping by left-handed individuals. Although FIGS. 4 and 12-14 may depict an egg-shaped or oval-shaped top view instead of a circular-shaped top view, the configuration of the head portions 120, 720, 820 and 920 is not limited this regard and the head portion 120 may have any configuration suitable for forming a hollow compartment 134 capable of covering various types of golf club heads 114.

Figure 2:
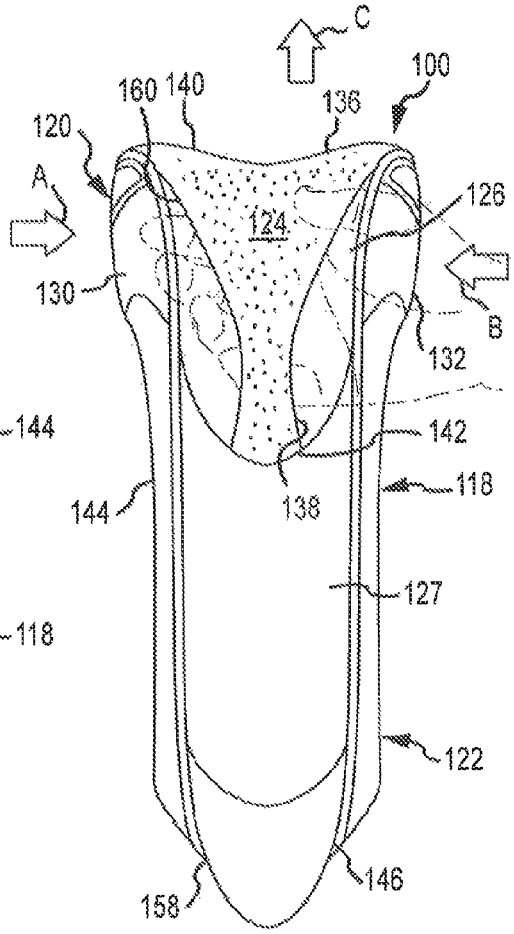
FIG. 2 is a rear view of the club head cover.
Figure 3:
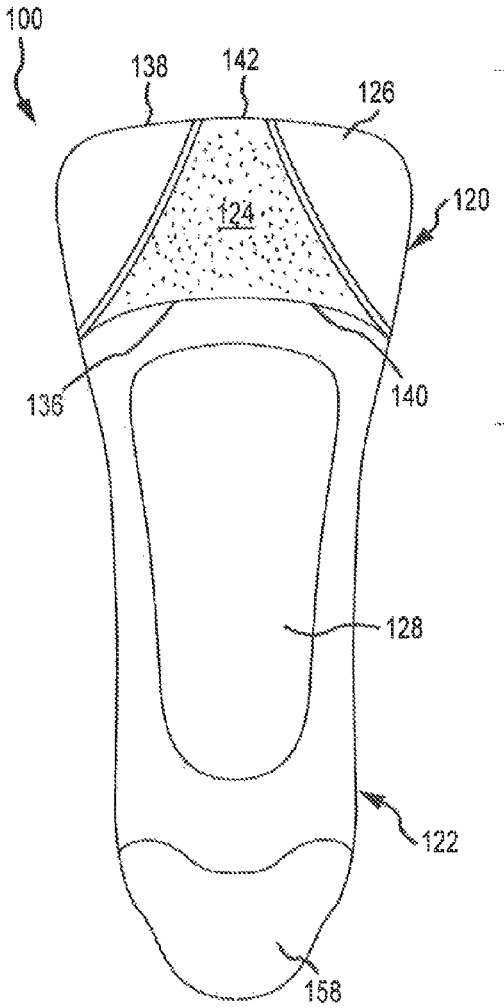
FIG. 3 is a front view of the club head cover.

As illustrated in FIG. 2, in one embodiment an individual may remove the club head cover 100 by inserting their hand (shown in phantom), such as the individual's four fingers, through the channel 160 defined between the pull strap 124 and the top wall 126 of the head portion 120 in either the A or the B direction and then the individual applies an upward force against the pull strap 124 in the C direction to remove the golf club cover 100 from the golf club head 114 using one hand as the individual grasps the golf club 112, such as the shaft 116, with the other hand. In this manner, the individual can apply a much greater force against the first strap end 140 of the pull strap 124 because of the proportionately greater amount of material of the pull strap 124 along the first strap end 140 that is engaged to the head portion 120 than the second strap end 142 so that a much larger and even force may be applied to remove the club head cover 100 from the golf club head 114 than would otherwise occur with a pull strap of constant thin width. This even force being applied to the pull strap 124 can also prevent the club head cover 100 from catching along portions of the golf club 112, which can inhibit removal of the club head cover 100. As such, a pull strap having a constant thin width is incapable of applying as much force on the first head end 136 of the club head cover 100 to facilitate removal from the golf club head 112. In addition, a pull strap of constant thin width cannot form a channel 160 that is sufficiently configured to allow an individual's four fingers to contact sufficient material to apply the force necessary to easily remove the club head cover 100. As shown in FIGS. 1-4, the pull strap 124 is configured to provide an aesthetic appearance in which the pull strap 124 appears to form a seamless, integral part of the head portion 120 of the club head cover 100.

Figure 9:
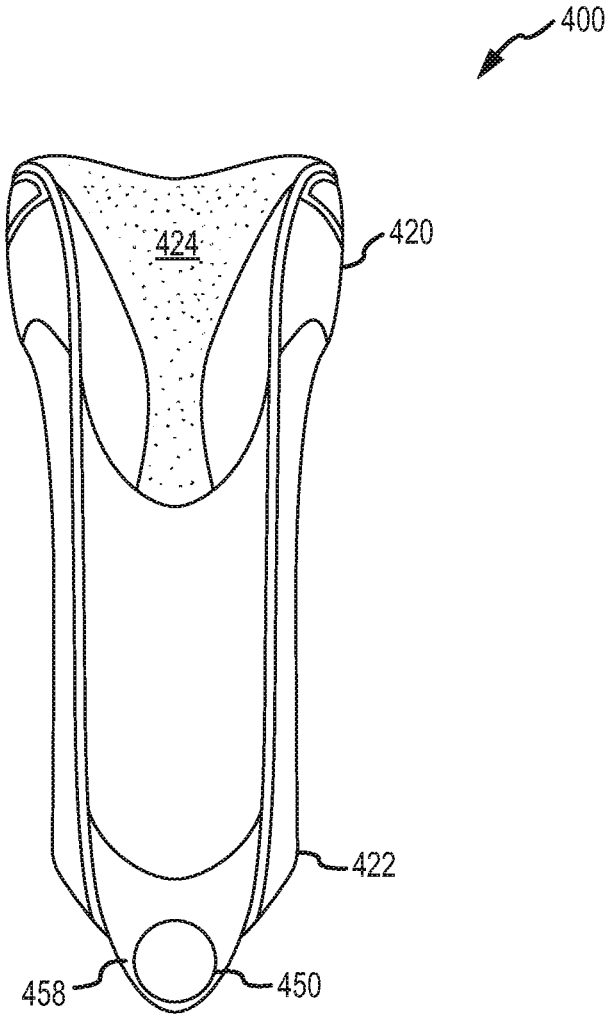
FIG. 9 is a rear view of the club head cover showing a hole of the sleeve portion.
Figure 10:
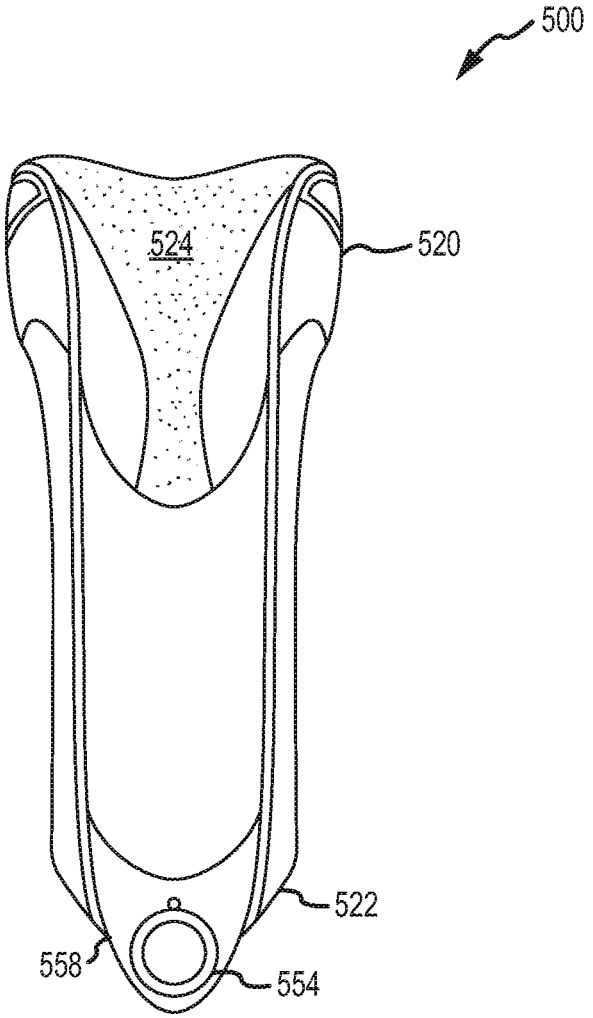
FIG. 10 is a rear view of the club head cover showing a ring of the sleeve portion.
Figure 11:
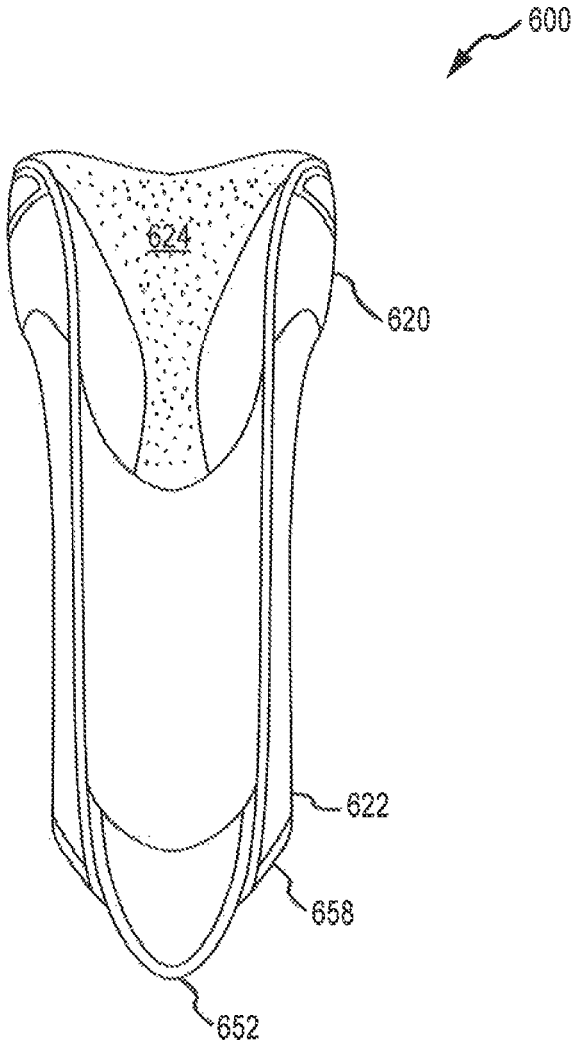
FIG. 11 is a rear view of the club head cover showing a cord arrangement of the sleeve portion.

Referring to FIGS. 7-11, in addition to including pull strap 124 for assisting in the removal of the club head cover 100, some embodiments of the club head cover 100 may include a handle portion for assisting the individual to engage the club head cover 100 onto the golf club head 114. In addition to pull strap 224 one embodiment of the club head cover, designated 200, shown in FIG. 7 the sleeve portion 222 may include an integral loop 256 formed by the material of the club head cover 200 that is configured to allow the individual to grasp the loop 256 and pull the club head cover 200 over the golf club head 114 via the open end 258 until the golf club head 114 is fully disposed inside the hollow compartment 134 of the head portion 220. In addition to pull strap 324 another embodiment of the club head cover, designated 300, shown in FIG. 8 the sleeve portion 322 may include a tab 348 defined along the sleeve portion 322 that is configured to allow the individual to grasp the tab 348 and pull the club head cover 300 over the golf club head 114 via the open end 358 until the golf club head 114 is fully disposed inside the hollow compartment 134 of the head portion 320. Referring to FIG. 9, in addition to pull strap 424 an embodiment of the club head cover, designated 400, may include a hole 450 that is defined through the sleeve portion 422 and is configured to allow the individual to grasp the hole 450 and pull the club head cover 400 over the golf club head 114 via the open end 458 until the golf club head 114 is fully disposed inside the hollow compartment 134 of the head portion 420. In addition to pull strap 524 yet another embodiment shown in FIG. 10, a club head cover, designated 500, may include a ring 554 attached to the sleeve portion 522 and is configured to allow the individual to grasp the ring 554 and pull the club head cover 500 over the golf club head 114 via the open end 558 until the golf club head 114 is fully disposed inside the hollow compartment 134 of the head portion 520. Referring to FIG. 11, in addition to pull strap 624 another embodiment of the club head cover, designated 600, may include a cord arrangement 652 that is embroidered into the fabric of the sleeve portion 622 and is configured to allow the individual to grasp the cord arrangement 652 and pull the club head cover 600 over the golf club head 114 via the open end 658 until the golf club head 114 is fully disposed inside the hollow compartment of the head portion 620. Although the above embodiments disclose various handle portions 256, 348, 450, 554 and 652 for engaging the respective club head covers 200, 300, 400, 500, and 600 to the golf club head 114, the apparatus, articles of manufacture, and methods described herein are not limited in this regard.

Figure 15:
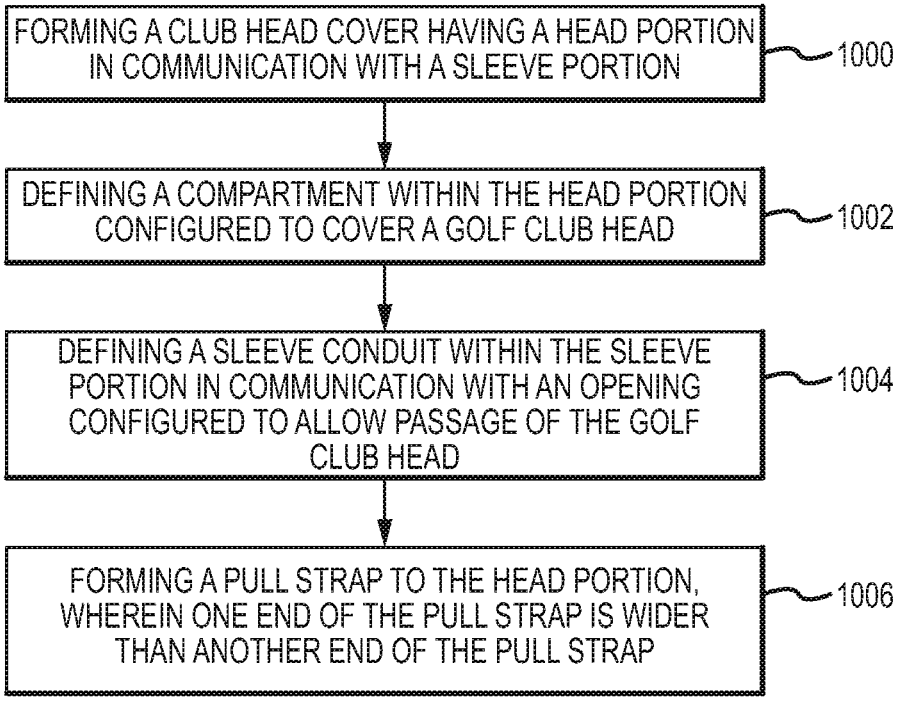
FIG. 15 is a flow chart illustrating a method of manufacturing the club head cover.

Referring to FIG. 15, a flow chart illustrates one method for manufacturing the club head cover 100. At block 1000, a club head cover 100 is formed having a head portion 120 and a sleeve portion 122. In some embodiments, the club head cover 100 is formed from at least one of leather, neoprene, polyethylene, polyurethane, synthetic rubber, acrylonitrile butadiene styrene (ABS), plastic, or fabric material. At block 1002, a hollow compartment 134 is defined within the head portion 120 which is configured to cover the golf club head 114. In one embodiment, the hollow compartment 134 is wider at or proximate to the first head end 136 than at or proximate the second head end 138. At block 1004, a sleeve conduit 162 is defined within the sleeve portion 122 so that the sleeve conduit 162 communicates with the open end 158 configured to allow the passage of the golf club head 114 into the sleeve conduit 162. At block 1006, a pull strap 124 is formed on the head portion 120 having a first strap end 140 wider than second strap end 142 of the pull strap 124. In one embodiment, the pull strap is formed by sewing the pull strap 124 to the head portion 120. In some embodiments, forming the pull strap 124 may include attaching the first strap end 140 of the pull strap 124 to the first head end 136 and the second strap end 142 of the pull strap 124 to the second head end 138. In addition, forming the pull strap 124 further includes forming the channel 162 to allow passage for an individual's hand to grasp the pull strap 124.

Figure 16:
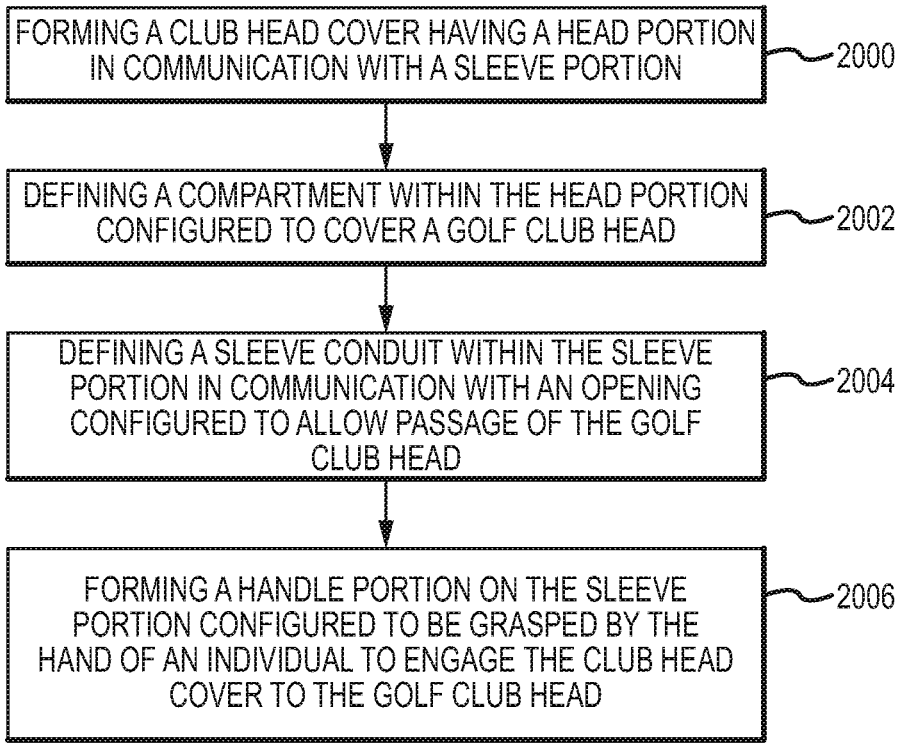
FIG. 16 is a flow chart illustrating another method of manufacturing the club head cover.

Referring to FIG. 16, a flow chart illustrates another method for manufacturing the club head cover 100. At block 2000, a club head cover 100 is formed having a head portion 120 and a sleeve portion 122. At block 2002, a hollow compartment is defined within the head portion 120 which is configured to cover the golf club head 114. At block 2004, a sleeve conduit 162 is defined within the sleeve portion so that the sleeve conduit 162 communicates with the open end 158 configured to allow the passage of the golf club head 114 into the sleeve conduit 162. At block 2006, a handle portion is formed on the sleeve portion 122 configured to be grasped by the hand of an individual to engage the club head cover 100 to the golf club head 114. Although the above flow charts illustrate various methods for manufacturing the club head cover 100, the same methods for manufacture may be applied to manufacturing club head covers 200, 300, 400, 500, 600, 700, 800 and 900.

Figure 17:
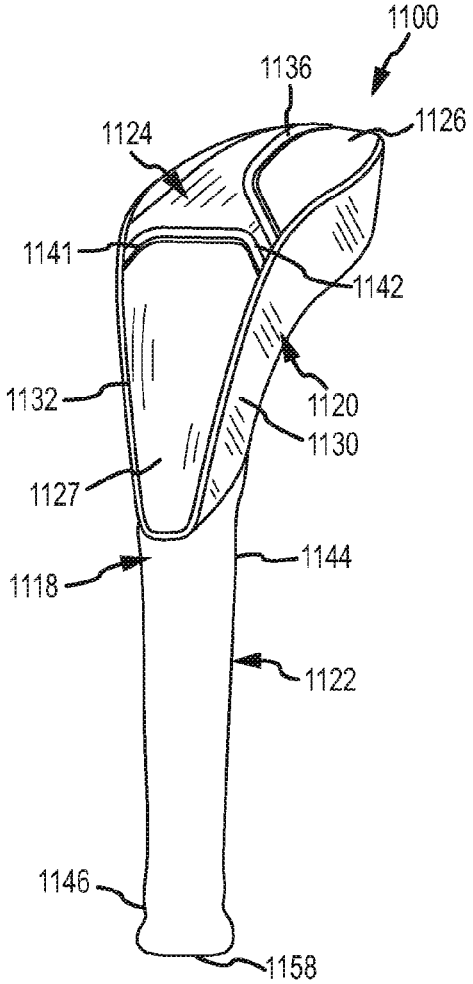
FIG. 17 is a perspective view of another embodiment of a club head cover showing a sleeve portion and a head portion that includes a Y-shaped pull strap.
Figure 18:
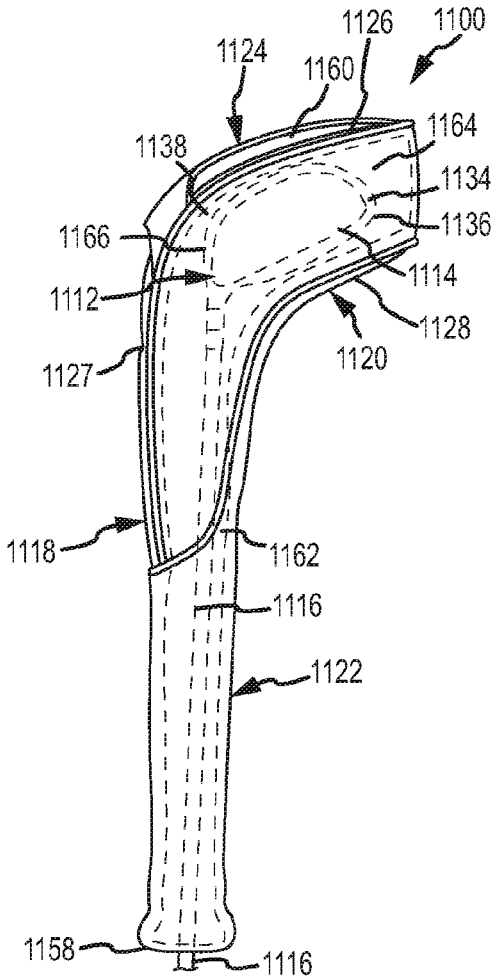
FIG. 18 is a side view of the club head cover illustrating the hollow compartment and sleeve conduit with a golf club disposed therein shown in phantom.
Figure 19:
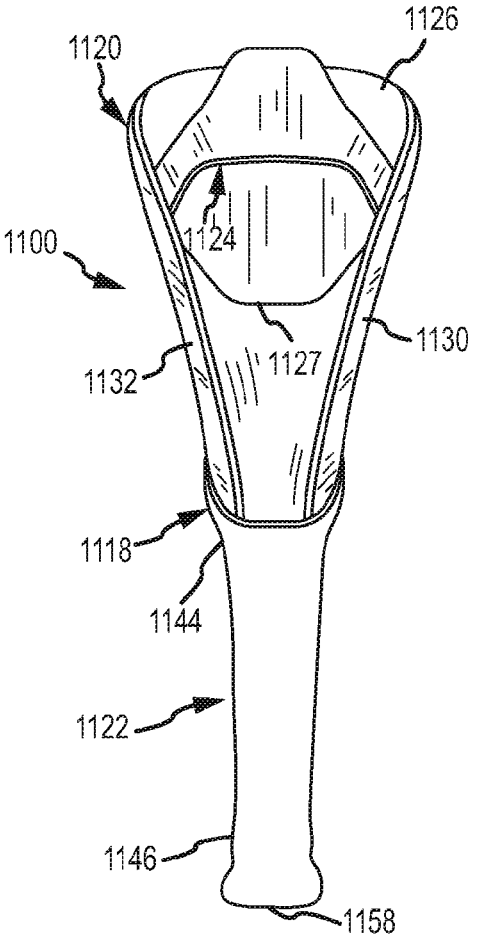
FIG. 19 is a rear view of the golf club cover with the Y-shaped pull strap.
Figure 20:
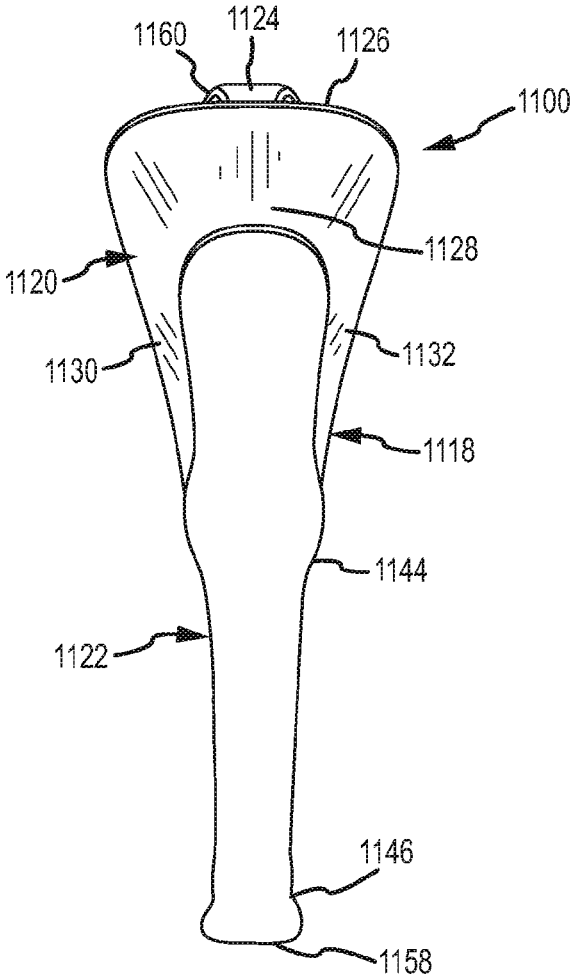
FIG. 20 is a front view of the golf club cover with the Y-shaped pull strap.
Figure 21:
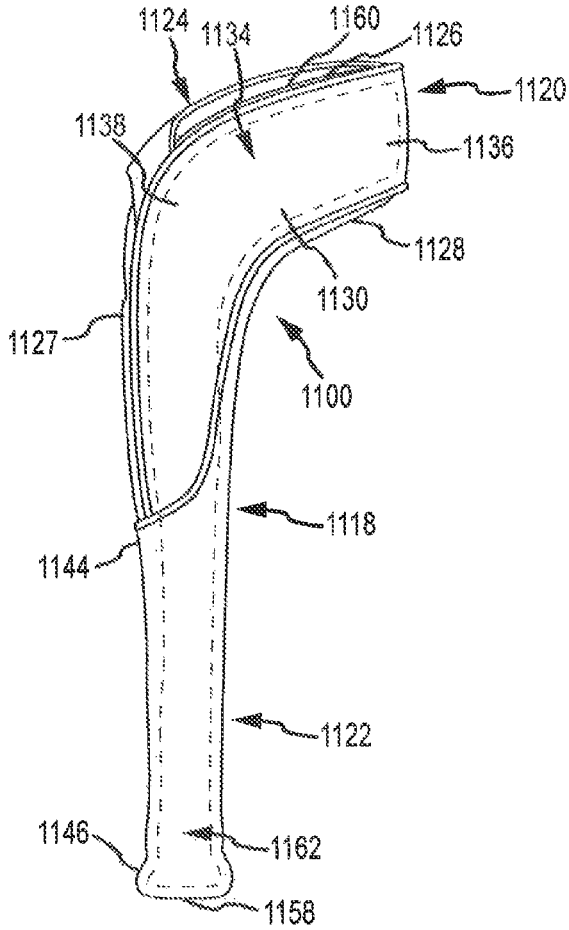
FIG. 21 is a side view of the golf club cover illustrating the hollow compartment and sleeve conduit in phantom.
Figure 22:
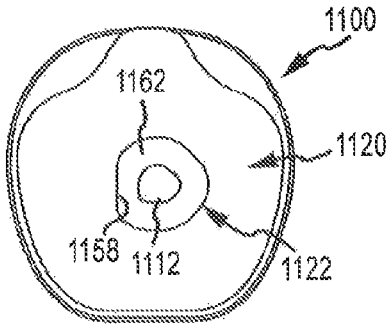
FIG. 22 is a bottom view of the golf club cover illustrating the shaft of the golf club disposed therein.

Referring to FIGS. 17-23, another embodiment of the club head cover, designated, 1100, is shown. The club head cover 1100 may have a flexible body 1118 defining a head portion 1120 and a sleeve portion 1122 configured to cover a golf club 1112 (FIGS. 18 and 22). In some embodiments, the head portion 1120 and the sleeve portion 1122 may form an L-shaped configuration. As shown in FIG. 18, the head portion 1120 defines a hollow compartment 1134 configured to receive and completely cover a golf club head 1114 of the golf club 1112, while the sleeve portion 1122 defines a sleeve conduit 1162 in communication with the hollow compartment 1134 in which the sleeve conduit 1162 defines an open end 1158. The open end 1158 allows passage of the golf club head 1114 through the sleeve conduit 1162 and permits a portion of the shaft 1116 of the golf club 1112 to be covered by the sleeve portion 1122 once the golf club head 1114 is fully disposed inside the hollow compartment 1134. In addition, the sleeve portion 1122 defines a distal portion 1144 formed adjacent the head portion 1120 and a proximal portion 1146 located farthest away from the head portion 1120 of the flexible body 1118. In some embodiments, the golf club 1112 may be associated with at least one of a driver-type golf club, a wood-type golf club, an iron-type golf club, a hybrid-type golf club, or a putter-type golf club; however, the apparatus, articles of manufacture, and methods described herein are not limited in this regard.

Referring to FIGS. 18 and 21, the golf club head 1114 defines a toe portion 1164 and a heel portion 1166, and the head portion 1120 defines a first head end 1136 and a second head end 1138. The toe portion 1164 and the heel portion 1166 fit within the hollow compartment 1134 and correspond to the first head end 1136 and the second head end 1138, respectively when the golf club head 1114 is disposed inside the hollow compartment 1134. In some embodiments, the hollow compartment 1134 of the head portion 1120 increases in size from the second head end 1138 to the first head end 1136 of the head portion 1120. In one embodiment, the hollow compartment 1134 is wider at or proximate to the first head end 1136 than at or proximate to the second head end 1138. In addition, a pull strap 1124 may be attached or integral with the head portion 1120 and is configured to allow an individual to remove the club head cover 1100 from the golf cub head 1114 as shall be discussed in greater detail below.

Figure 23:
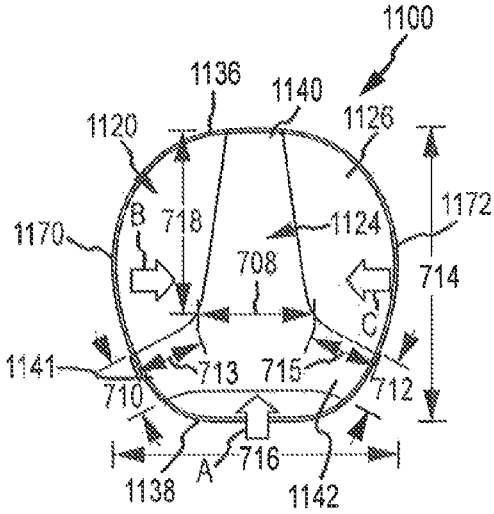
FIG. 23 is a top view of the golf club cover illustrating a first orientation of the Y-shaped pull strap.

Referring to FIGS. 17-21, the flexible body 1118 of the club head cover 1100 further defines a top wall 1126, a rear wall 1127, a front wall 1128, a first side wall 1130, and a second side wall 1132 that collectively define the hollow compartment 1134 and the sleeve conduit 1162 of the club head cover 1100. In some embodiments as shown in FIG. 23, the pull strap 1124 may have a first strap portion 1140, a second strap portion 1141 and a third strap portion 1142 that collectively define a substantially triangular or Y-shaped configuration in which both the first strap portion 1140 has a width wider than either the second strap portion 1141 or third strap portion 1142, which may have similar widths. In other embodiments, the first strap portion 1140 may have the same width as the second strap portion 1141 and third strap portion 1142. As shown in FIG. 23, one embodiment of the first strap portion 1140 has a width 708 of about 2.25 inches, while the second strap portion 1141 and the third strap portion 1142 both have widths 710 and 712 of about 1 inch. In addition, the first strap portion 1140 may have an inner length 718 of about 2.5 inches and an outer length 714 of about 4 inches, while a length 716 of the second and third strap portions 1141 and 1142 may collectively be about 3.75 inches. As further shown, the length 713 of the second strap portion 1141 is about 1.5 inches and the length 715 of the third strap portion

1142 is about 1.5 inches. In some embodiments, the respective lengths 713 and 715 of the second strap portion 1141 and third strap portion 1142 may be the same. In some embodiments, the width 708 may be between 1 to 3 inches, widths 710 and 712 may be between 0.5 to 2 inches, inner length 718 may be between 0.75 to 2 inches, outer length 714 may be between 3.75 to 6 inches, length 713 may be between 1 to 2.5 inches, length 715 may be between 1 to 2.5 inches, and length 716 may be between 3 to 5 inches. The apparatus, articles of manufacture, and methods described herein are not limited in this regard.

In some embodiments, the pull strap 1124 may be attached to at least three different portions of the top wall 1126 so that a channel 1160 is defined between the pull strap 1124 and the top wall 1126 of the head portion 1120. As shown in FIG. 23, the head portion 1120 may be defined by a first head end 1136, a second head end 1138, a third head end 1170 and a fourth head end 1172. Besides the top portion 1164 and the heel portion 1166, the golf club head 1114 also defines a back portion and a face portion. The back portion and the face portion fit within the hollow compartment 1134 and correspond to the third head end 1170 and the fourth head end 1172, respectively when the golf club head 1114 is disposed inside the hollow compartment 1134.

In one embodiment, the pull strap 1124 may be attached to the top wall 1126 of the head portion 1120 in a first orientation so that the respective end of the first strap portion 1140 is attached to or integral with the first head end 1136, the respective end of the second strap portion 1141 is attached to or integral with between the second head end 1138 and the third head end 1170, and the respective end of the third strap portion 1142 is attached to or integral with between the second head end 1138 and the fourth head end 1172 of the head portion 1120. In this orientation, the first strap portion 1140 extends in a longitudinal direction away from the first head end 1136, while the second strap portion 1141 extends in a generally latitudinal direction away from the third head end 1170 and the third strap portion 1142 also extends in a generally latitudinal direction away from the fourth head end 1172. Referring back to FIG. 18, for example, the hollow compartment 1134 at the first head end 1136 of the head portion 1120 may cover the toe portion 1164 of the golf club head 1114, whereas the hollow compartment 1134 at or proximate to the second head end 1138 of the head portion 1120 may cover the heel portion 1166 of the golf club head 1114. In this orientation, an individual grasping the pull strap 1124 can apply a greater upward force to the heel portion 1166 of the golf club head 1114 than the toe portion 1164 of the golf club head 1114. However, in other embodiments, the pull strap 1124 may be oriented in different orientations as discussed in greater detail below.

Figure 24:
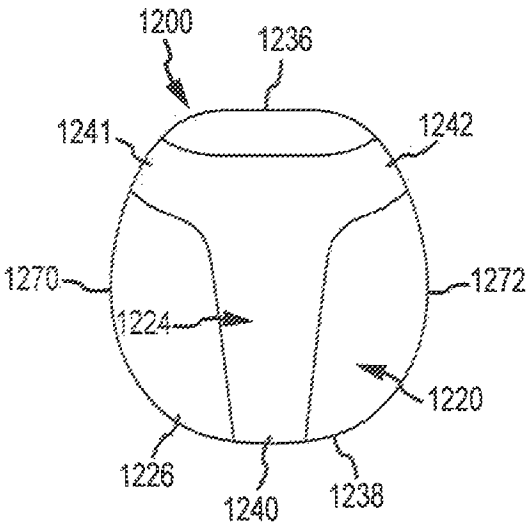
FIG. 24 is a top view of the golf club cover illustrating a second orientation of the Y-shaped pull strap.

Referring to FIG. 24, one embodiment of the club head cover, designated 1200, may include a head portion 1220 having a top wall 1226 that defines a first head end 1236, a second head end 1238, a third head end 1270 and a fourth head end 1272. In contrast to pull strap 1124, the pull strap may be attached or integral with the head portion 1220 in a second orientation so that the end of the first strap portion 1240 is attached or integral with the second head end 1238, while the end of the second strap portion 1241 is attached or integral between the third head end 1270 and the first head end 1236 and the third strap portion 1242 is attached or integral between the first head end 1236 and the fourth head end 1272. In contrast to the pull strap 1124 of FIG. 23, the first strap portion 1240 of pull strap 1224 tapers from the second head end 1238 to the first head end 1236 of the head portion 1220. As such, pull strap 1224 is attached to the head portion 1220 in an opposite orientation relative to pull strap 1124. As shown, the first strap portion 1240 extends in a longitudinal direction away from the second head end 1238, while the second strap portion 1241 extends in a generally latitudinal direction away from the third head end 1270 and the third strap portion 1242 extends in a generally latitudinal direction away from the fourth head end 1272. In this orientation, an individual grasping the pull strap 1224 can apply a greater upward force to the toe portion 1164 of the golf club head 1114 than the heel portion 1166 of the golf club head 1114 when removing the club head cover 1200.

Figure 25:
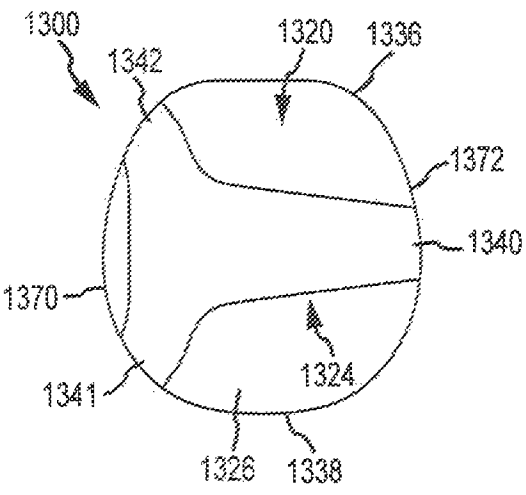
FIG. 25 is a top view of the golf club cover illustrating a third orientation of the Y-shaped pull strap.

Referring to FIG. 25, one embodiment of the club head cover, designated 1300, may include a head portion 1320 having a top wall 1326 that defines a first head end 1336, a second head end 1338, a third head end 1370, and a fourth head end 1372. In contrast to the pull straps 1124 and 1224, the pull strap may be attached or integral with the head portion 1320 in a third orientation that is in transverse orientation relative to either the pull strap 1124 or pull strap 1224 so that the end of the first strap portion 1340 is attached or integral with the fourth head end 1372, the end of the second strap portion 1341 is attached or integral between the second head end 1338 and the third head end 1370, and the end of the third strap portion 1342 is attached or integral between the first head end 1336 and the third head end 1370. This is analogous to rotating the pull strap 1124 of FIG. 23 clockwise 90°. In this orientation, an individual grasping the pull strap 1324 can apply a greater upward force to the back portion of the golf club head 1114 than the face portion of the golf club head 1114 when removing the club head cover 1300. In further contrast to the embodiments shown in FIGS. 23 and 24, the pull strap 1324 may be relatively shorter than pull straps 1124 and 1224 as the pull strap 1324 extends substantially along length 716. As shown, the pull strap 1324 extends in a latitudinal direction or width-wise across the head portion 1320. In one aspect, the pull strap 1324 is configured for grasping by right-handed individuals.

Figure 26:
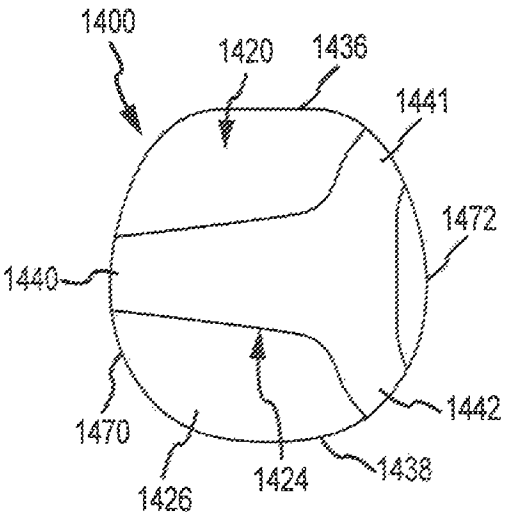
FIG. 26 is a top view of the golf club cover illustrating a fourth orientation of the Y-shaped pull strap.

Referring to FIG. 26, one embodiment of the club head cover, designated 1400, may include a head portion 1420 having a top wall 1426 that defines a first head end 1436, a second head end 1438, a third head end 1470, and a fourth head end 1472. In contrast to the pull strap 1324 of FIG. 25, the pull strap 1424, may be attached or integral with the head portion 1420 in a fourth orientation that is opposite to the orientation of pull strap 1324 so that the end of the first strap portion 1440 of the pull strap 1424 is attached or integral with the third head end 1470, while the end of the second strap portion 1441 is attached or integral between the first head end 1436 and the fourth head end 1472 and the end of the third strap portion 1442 is attached or integral between the second head end 1438 and the fourth head end 1472. The first strap portion 1440 may be wider than either the second strap portion 1441 or third strap portion 1442 so that the pull strap 1424 tapers from the third head end 1470 to the fourth head end 1472. This is analogous to rotating the pull strap 1124 of FIG. 23 counterclockwise by 90°. In this orientation, an individual grasping the pull strap 1424 can apply a greater upward force to the face portion of the golf club head 1114 than the back portion of the golf club head 1114 when removing the club head cover 1400. In addition, the pull strap 1424 is configured for grasping by left-handed individuals. Although FIGS. 23-26 may depict an egg-shaped or oval-shaped top view instead of a circular-shaped top view, the configuration of the head portions 1120, 1220, 1320 and 1420 is not limited in this regard and the head portion 1120 may have any configuration suitable for forming a hollow compartment 1134 capable of covering various types of golf club heads 1114.

As illustrated in FIG. 23, in some embodiments an individual may remove the club head cover 1100 by inserting their hand through the channel 1160 formed by the pull strap 1124. For example, the individual may insert their hand in the A direction under the second and third strap portions 1141 and 1142 such that the three middle fingers of the individual are disposed within the channel 1160 or the individual may insert either two, three or four fingers under the first strap portion 1140 in either the B or C direction under the first strap portion 1140. In this manner, the individual can apply a much greater force to remove the club head cover 1100 because an upward force is being applied at three different portions along the head portion 1120 by the respective three ends of the first, second and third strap portions 1140, 1141 and 1142 of the pull strap 1124 so that a much larger and distributed force may be applied to the head portion 1120 to remove the club head cover 1100 from the golf club head 1114 than would otherwise occur with a single strap arrangement in which the pull strap is connected at only two points to the head portion 1120. As such, a single pull strap arrangement with only two portions of the pull strap connected to the head portion 1120 is incapable of applying a force along three different portions of the club head cover 1100 as the pull strap 1124, which defines three portions 1140, 1141 and 1142 attached or integral with the club head cover 1100, to facilitate removal from the golf club head 1112. In addition, a single pull strap arrangement is limited to only two orientations for grasping the pull strap; for example right-handed or left-handed orientations, while the club head cover 1100 is configured to permit the individual to grasp the pull strap 1124 from three different orientations—designated A, B and C directions. In the A direction, the individual grasps the pull strap 1124 at an orientation transverse to when the pull strap 1124 is pulled in either the B or C directions. For example, the individual grasps the pull strap 1124 within the portion of the channel 1160 formed under the second and third strap portions 1141 and 1142 when grasping the pull strap 1124 in the A direction, while the individual grasps the pull strap 1124 within the portion of the channel 1160 formed under the first strap portion 1140 when grasping the pull strap 1124 in either the B or C directions.

As shown in FIG. 17, the pull strap 1124 is configured to provide an aesthetic appearance in which the pull strap 1124 appears to form a seamless, integral part of the head portion 1120 of the club head cover 1100.

Figure 27:
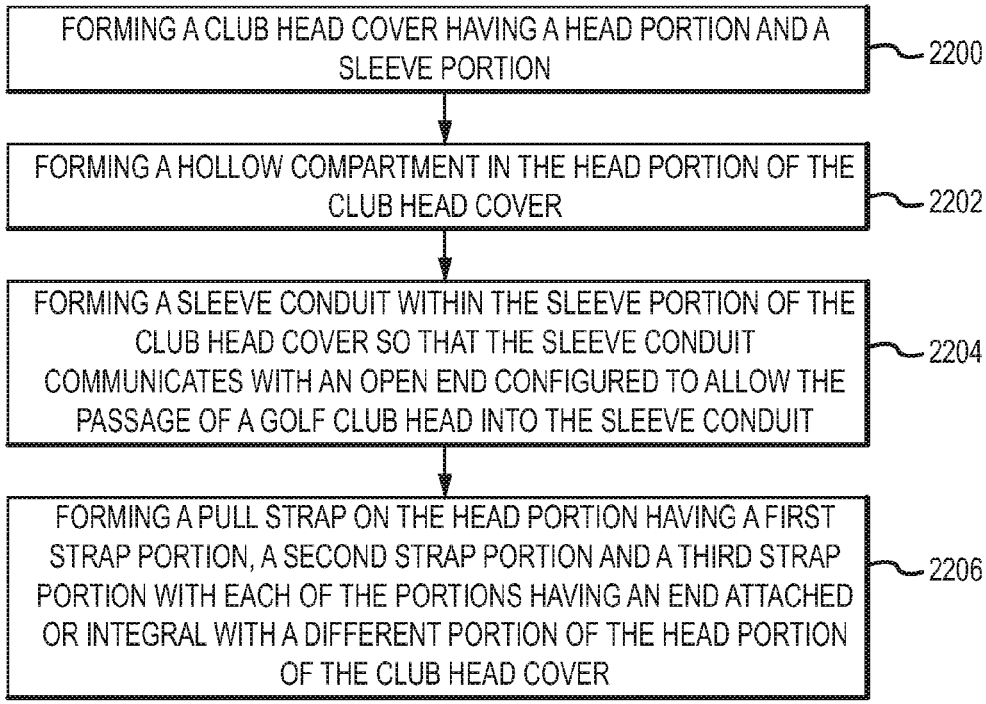
FIG. 27 is a flow chart illustrating a method of manufacturing the golf club cover.
Figure 28:
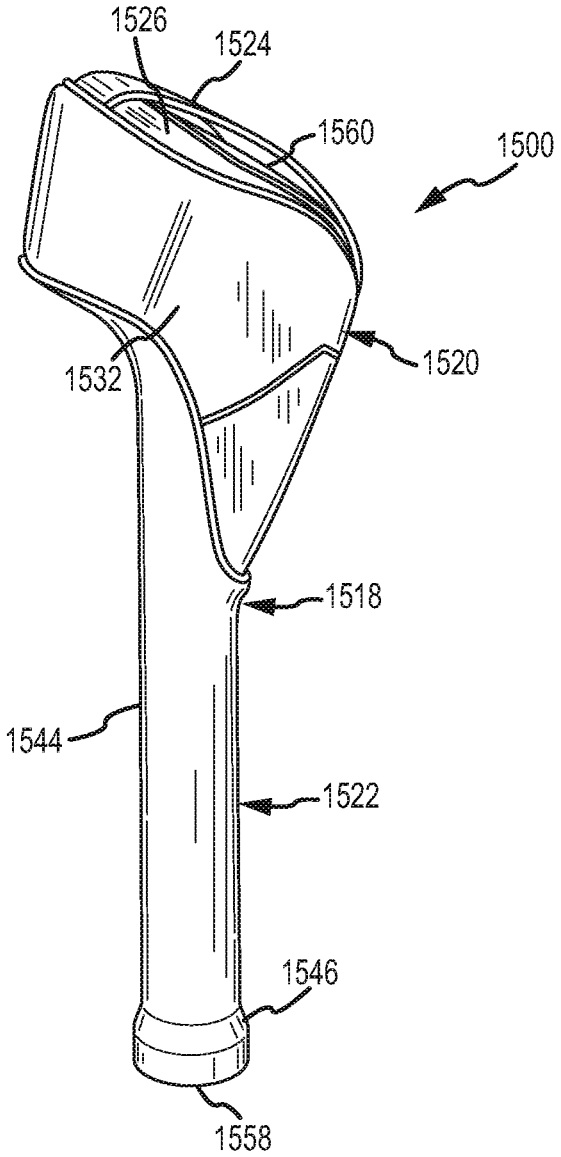
FIG. 28 is a perspective view of yet another embodiment of the golf club cover showing a sleeve portion and a head portion that includes an I-shaped pull strap.
Figure 29:
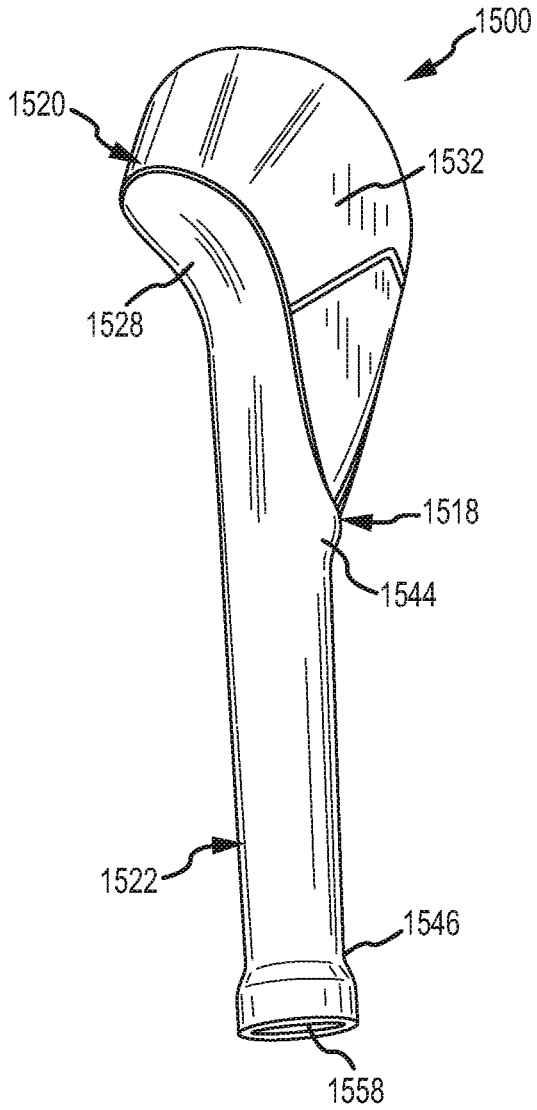
FIG. 29 is another perspective view of the golf club cover with an I-shaped pull strap shown in FIG. 28.

Referring to FIG. 27 a flow chart illustrates one method of manufacturing the club head cover 1100. At block 2200, a club head cover is formed having a head portion 1120 and a sleeve portion 1122. In some embodiments, the club head cover 1100 is formed from at least one of leather, neoprene, polyethylene, polyurethane, synthetic rubber, acrylonitrile butadiene styrene (ABS), plastic, or fabric material. At block 2202, a hollow compartment 1134 is formed within the head portion 1120 which is configured to cover the golf club head 1114. In one embodiment, the hollow compartment 1134 is wider at or proximate to the first head end 1136 than at or proximate the second head end 1138. At block 2204, a sleeve conduit 1162 is formed within the sleeve portion 1122 so that the sleeve conduit 1162 communicates with the open end 1158 configured to allow the passage of the golf club head 1114 into the sleeve conduit 1162. At block 2206, a pull strap 1124 is formed on the head portion 1120 having a first strap portion 1140, a second strap portion 1141 and a third strap portion 1142, wherein each of the first, second and third portions 1140, 1141 and 1142 having a respective free end attached or integral with a different portion of the head portion 1120. In one embodiment, the pull strap 1124 is formed by sewing the pull strap 1124 to the head portion 1120. In some embodiments, forming the pull strap 1124 may include attaching the first strap portion 1140 of the pull strap 1124 to the first head end 1136, attaching the second strap portion 1141 of the pull strap 1124 between the third head end 1170 and the second head end 1138, and attaching the third strap portion 1142 of the pull strap 1124 between the fourth head end 1172 and the second head end 1138. In addition, forming the pull strap 1124 further includes forming a channel 1160 to allow passage for an individual's hand to grasp the pull strap 1124 from three different directions.

Figure 32:
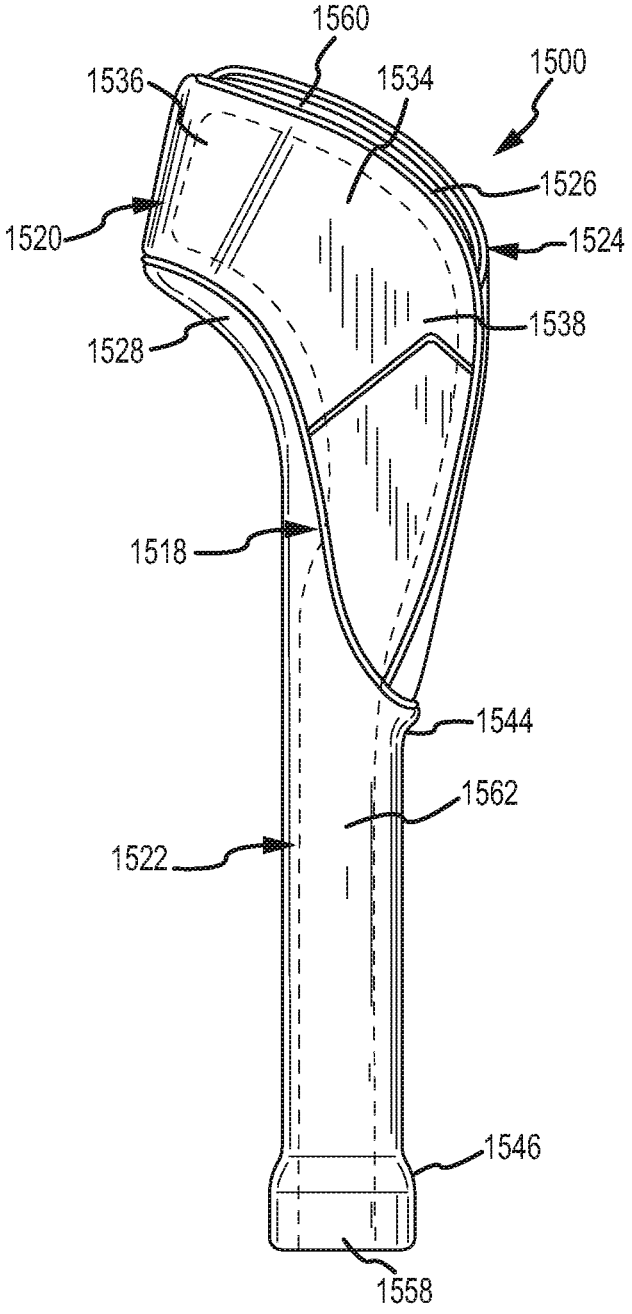
FIG. 32 is a side view of the golf club cover illustrating the hollow compartment and sleeve conduit in phantom.
Figure 33:
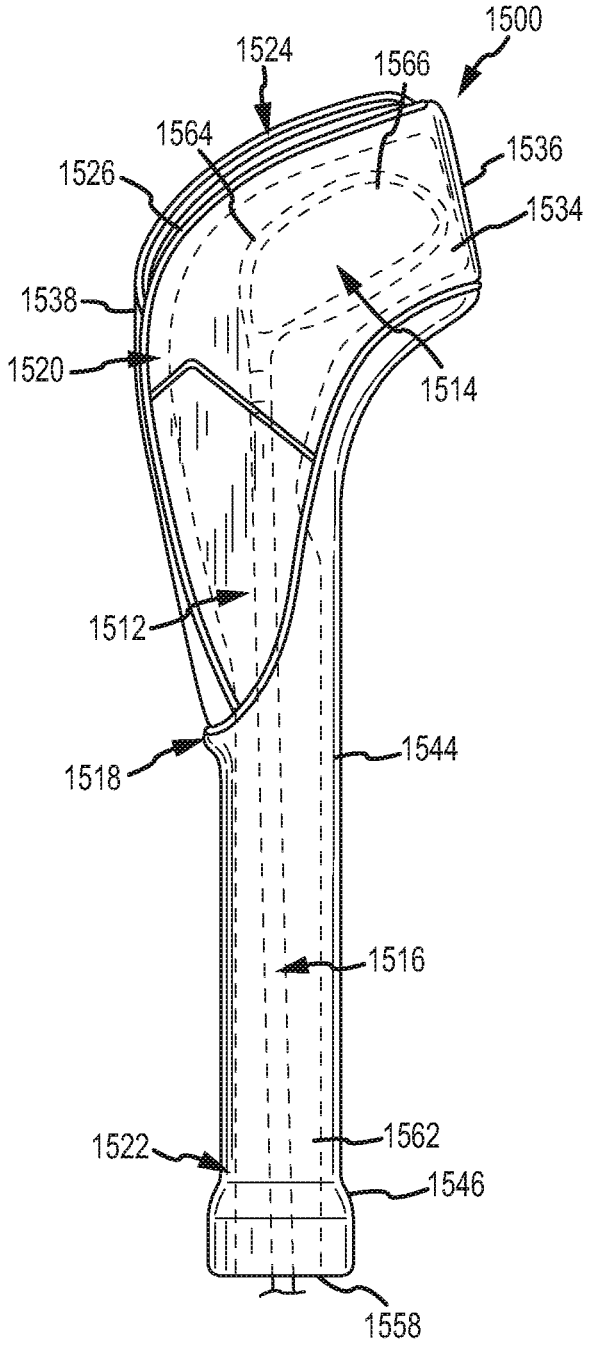
FIG. 33 is an opposing side view of the golf club cover of FIG. 32 illustrating the hollow compartment and sleeve conduit in phantom.
Figure 34:
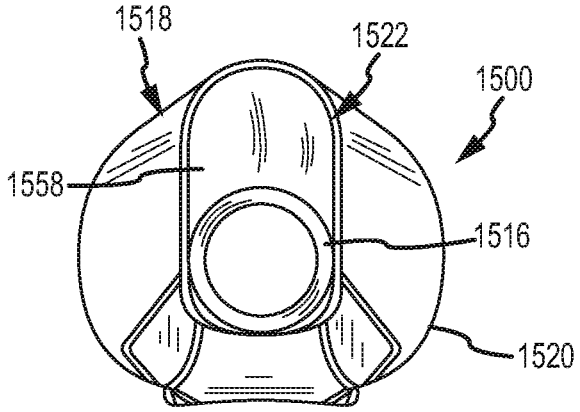
FIG. 34 is a bottom view of the golf club cove illustrating the shaft of the golf club disposed therein.

Referring to FIGS. 28-35 another embodiment of the club head cover, designated, 1500, is shown. The club head cover 1500 may have a flexible body 1518 defining a head portion 1520 and a sleeve portion 1522 configured to cover a golf club 1512 (FIG. 33). In some embodiments, the head portion 1520 and the sleeve portion 1522 may form an L-shaped configuration. As shown in FIG. 33, the head portion 1520 defines a hollow compartment 1534 configured to receive and completely cover a golf club head 1514 of the golf club 1512, while the sleeve portion 1522 defines a sleeve conduit 1562 in communication with the hollow compartment 1534 in which the sleeve conduit 1562 defines an open end 1558. The open end 1558 allows passage of the golf club head 1514 through the sleeve conduit 1562 and permits a portion of the shaft 1516 of the golf club 1512 to be covered by the sleeve portion 1522 once the golf club head 1514 is fully disposed inside the hollow compartment 1534. In addition, the sleeve portion 1522 defines a distal portion 1544 formed adjacent the head portion 1520 and a proximal portion 1546 located farthest away from the head portion 1520 of the flexible body 1518. In some embodiments, the golf club 1512 may be associated with at least one of a driver-type golf club, a wood-type golf club, an iron-type golf club, a hybrid-type golf club, or a putter-type golf club; however, the apparatus, articles of manufacture, and methods described herein are not limited in this regard.

Referring to FIGS. 32 and 33, the golf club head 1514 defines a toe portion 1566 and a heel portion 1564, and the head portion 1520 defines a first head end 1536 and a second head end 1538. The toe portion 1566 and the heel portion 1564 fit within the hollow compartment 1534 and correspond to the first head end 1536 and the second head end 1538, respectively when the golf club head 1514 is disposed inside the hollow compartment 1534. In some embodiments, the hollow compartment 1534 of the head portion 1520 increases in size from the second head end 1538 to the first head end 1536 of the head portion 1520. In one embodiment, the hollow compartment 1534 is wider at or proximate to the first head end 1536 than at or proximate to the second head end 1538. In addition, the pull strap 1524 may be attached or integral with the head portion 1520 and is configured to allow an individual to remove the club head cover 1500 from the golf club head 1514 as shall be discussed in greater detail below.

Figure 35:
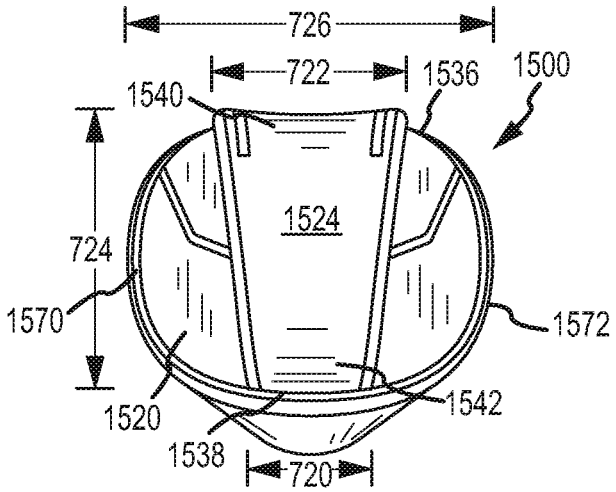
FIG. 35 is a top view of the golf club cover illustrating a first orientation of the I-shaped pull strap.

Referring to FIGS. 28-31, the flexible body 1518 of the club head cover 1500 further defines a top wall 1526, a rear wall 1527, a front wall 1528, a first side wall 1530, and a second side wall 1532 that collectively define the hollow compartment 1534 and the sleeve conduit 1562 of the club head cover 1500. In one embodiment, the pull strap 1524 may include a first strap end 1540 and a second strap end 1542 in which the first strap end 1540 has a width wider than the second strap end 1542 of the pull strap 1524. As shown in FIG. 35, one embodiment of the second strap end 1542 of pull strap 1524 has a width 720 of about 1.5 inches, while the first strap end 1540 of pull strap 1524 has a width 722 of about 3.75 inches. In addition, the top wall 1526 of the head portion 1520 may have a length 724 of about 6 inches, which corresponds to the overall length of the pull strap 1524 and a width 726 of about 5.5 inches. In some embodiments, width 720 may be between 1 to 3 inches, width 722 may be between 3 to 5.5 inches, length 724 may be between 5 to 8 inches, and width 726 may be between 4 to 6 inches. The apparatus, articles of manufacture, and methods described herein are not limited in this regard.

In some embodiments, the pull strap 1524 may be attached to the top wall 1526 of the head portion 1520 so that a channel 1560 is defined between the pull strap 1524 and the top wall 1526 of the head portion 1520. As shown in FIG. 35, the head portion 1520 may be defined by first head end 1536, second head end 1538, a third head end 1570 and a fourth head end 1572. Besides the top portion 1566 and the heel portion 1564, the golf club head 1514 also defines a back portion and a face portion. The back portion and the face portion fit within the hollow compartment 1534 and correspond to the third head end 1570 and the fourth head end 1572, respectively when the golf club head 1514 is disposed inside the hollow compartment 1534.

In one embodiment, the pull strap 1524 may be attached to the top wall 1526 of the head portion 1520 in a first orientation so that the first strap end 1540 of the pull strap 1524 is attached or integral with the first head end 1536 of the head portion 1520 and the second strap end 1542 of the pull strap 1524 is attached or integral with the second head end 1538 of the head portion 1520 as illustrated in FIG. 35. The first strap end 1540 is wider than the second strap end 1542 so that the pull strap 1524 tapers from the first head end 1536 to the second head end 1538. Referring back to FIG. 33, for example, the hollow compartment 1534 at the first head end 1536 of the head portion 1520 may cover the toe portion 1566 of the golf club head 1514, whereas the hollow compartment 1534 at or proximate to the second head end 1538 of the head portion 1520 may cover the heel portion 1564 of the golf club head 1514. In this orientation, an individual grasping the pull strap 1524 can apply a greater upward force to the heel portion 1564 of the golf club head 1514 than the toe portion 1566 of the golf club head 1514. However, in other embodiments, the pull strap 1524 may be oriented in different orientations.

Figure 36:
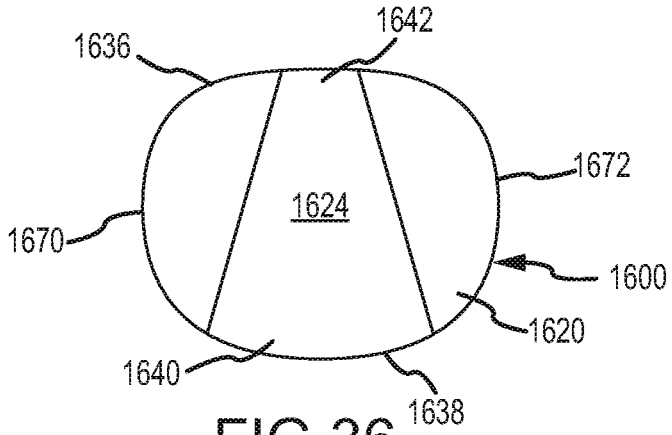
FIG. 36 is a top view of the golf club cover illustrating a second orientation of the I-shaped pull strap.

Referring to FIG. 36, one embodiment of the club head cover, designated 1600, may include a head portion 1620 that defines a first head end 1636, a second head end 1638, a third head end 1670 and a fourth head end 1672. In contrast to pull strap 1524, the pull strap 1624 may be attached or integral with the head portion 1620 in a second orientation so that the first strap end 1640 of the pull strap 1624 is attached or integral with the second head end 1638 and the second strap end 1642 of the pull strap 1624 is attached or integral with the first head end 1636. In contrast to pull strap 1524 of FIG. 35, the first strap end 1640 of FIG. 36 is wider than the second strap end 1642 so that the pull strap 1624 tapers in a linear fashion from the second head end 1638 to the first head end 1636. Pull strap 1524 of FIG. 35 tapers from the second head end 1538 to the first head end 1536. As such, pull strap 1624 is attached to the head portion 1620 in an opposite orientation relative to pull strap 1524 of FIG. 35. As shown in FIG. 36, for example, the hollow compartment 1534 at the first head end 1636 may cover the toe portion 1566 of the golf club head 1514, whereas the hollow compartment 1534 at or proximate to the second head end 1638 may cover the heel end 1564 of the golf club head 1514. In this orientation, an individual grasping the pull strap 1624 can apply a greater upward force to the toe portion 1566 of the golf club head 1514 than the heel portion 1564 of the golf club head 1514. As shown, the pull strap 1624 extends longitudinally or length-wise across the head portion 1620.

Figure 37:
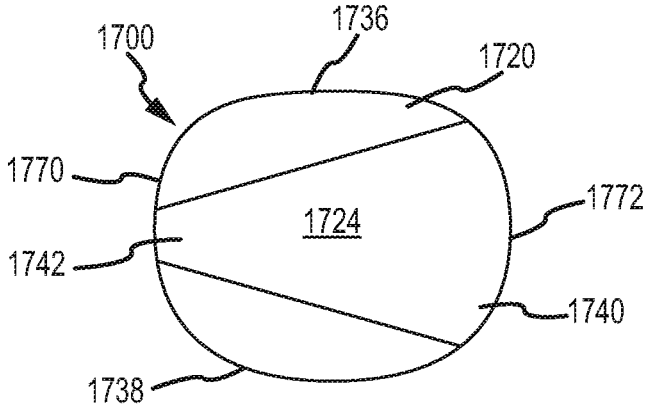
FIG. 37 is a top view of the golf club cover illustrating a third orientation of the I-shaped pull strap.

Referring to FIG. 37, one embodiment of the club head cover, designated 1700, may include a head portion 1720 that defines a first head end 1736, a second head end 1738, a third head end 1770 and a fourth head end 1772. In contrast to the pull strap 1624 shown in FIG. 36, a pull strap 1724 may be attached or integral with the head portion 1720 in a third orientation that is in transverse orientation relative to either the pull strap 1524 or pull strap 1624 so that the first strap end 1740 of the pull strap 1724 is attached or integral with the fourth head end 1772 and the second strap end 1742 of the pull strap 1724 is attached or integral with the third head end 1770. The first strap end 1740 of FIG. 37 is wider than the second strap end 1742 so that the pull strap 1724 tapers in a linear fashion from the third head end 1770 to the fourth head end 1772. This is analogous to rotating the strap 1524 of FIG. 35 clockwise 90° so that the first end strap 1540 is now at the third head end 1570 and the second end strap 1542 is at the fourth head end 1572. In this orientation, an individual grasping the pull strap 1724 can apply a greater upward force to the face portion of the golf club head 1514 than the back portion of the golf club head 1514 when removing the club head cover 1700. In further contrast to the embodiment shown in FIG. 35, the pull strap 1724 may be relatively shorter than the pull strap 1624 as the pull strap 1724 extends substantially along length 726. As shown, the pull strap 1724 extends in a latitudinal direction or width-wise across the head portion 1720. In one aspect, the pull strap 1724 is configured for grasping by right-handed individuals.

Figure 38:
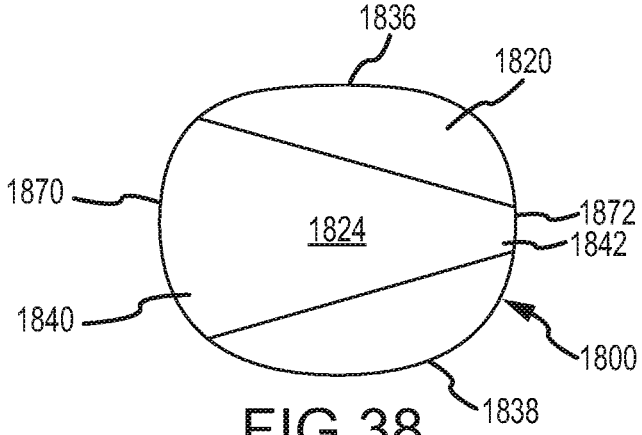
FIG. 38 is a top view of the golf club cover illustrating a fourth orientation of the I-shaped pull strap.

Referring to FIG. 38, one embodiment of the club head cover, designated 1800, may include a head portion 1820 that defines a first head end 1836, a second head end 1838, a third head end 1870 and a fourth head end 1872. In contrast to the pull strap 1724 of FIG. 37, the pull strap 1824 may be attached or integral with the head portion 1820 in a fourth orientation that is opposite to the orientation of pull strap 1724 so that the first strap end 1840 of the pull strap 1824 is attached or integral with the third head end 1870 and the second strap end 1842 of the pull strap 1824 is attached or integral with the fourth head end 1872. The first strap end 1840 of FIG. 38 is wider than the second strap end 1842 so that the pull strap 1824 tapers in a linear fashion from the third head end 1870 to the fourth head end 1872. This is analogous to rotating the pull strap 1524 of FIG. 35 counterclockwise 90° so that the first strap end 1540 is now at the third head end 1570 and the second strap end 1542 is attached to the fourth head end 1572. In this orientation, an individual grasping the pull strap 1824 can apply a greater upward force to the back portion of the golf club head 1514 than the face portion of the golf club head 1514 when removing the club head cover 1800. In one aspect, the pull strap 1824 may have substantially the same length 726 as pull strap 1724. In addition, the pull strap 1824 is configured for grasping by left-handed individuals. Although FIGS. 34-38 may depict an egg-shaped or oval-shaped top view instead of a circular-shaped top view, the configuration of the head portions 1520, 1620, 1720 and 1820 is not limited this regard and the head portion 1520 may have any configuration suitable for forming a hollow compartment 1534 capable of covering various types of golf club heads 1514.

Figure 30:
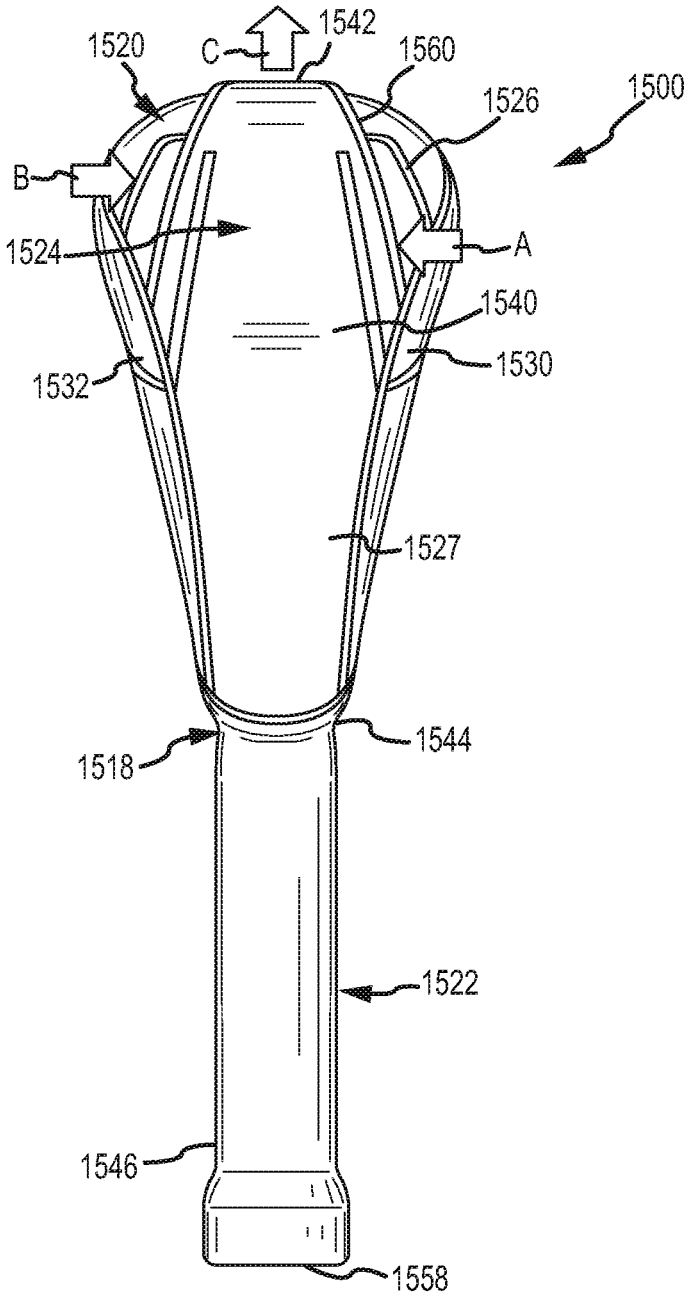
FIG. 30 is a rear view of the golf club cover with the I-shaped pull strap.
Figure 31:
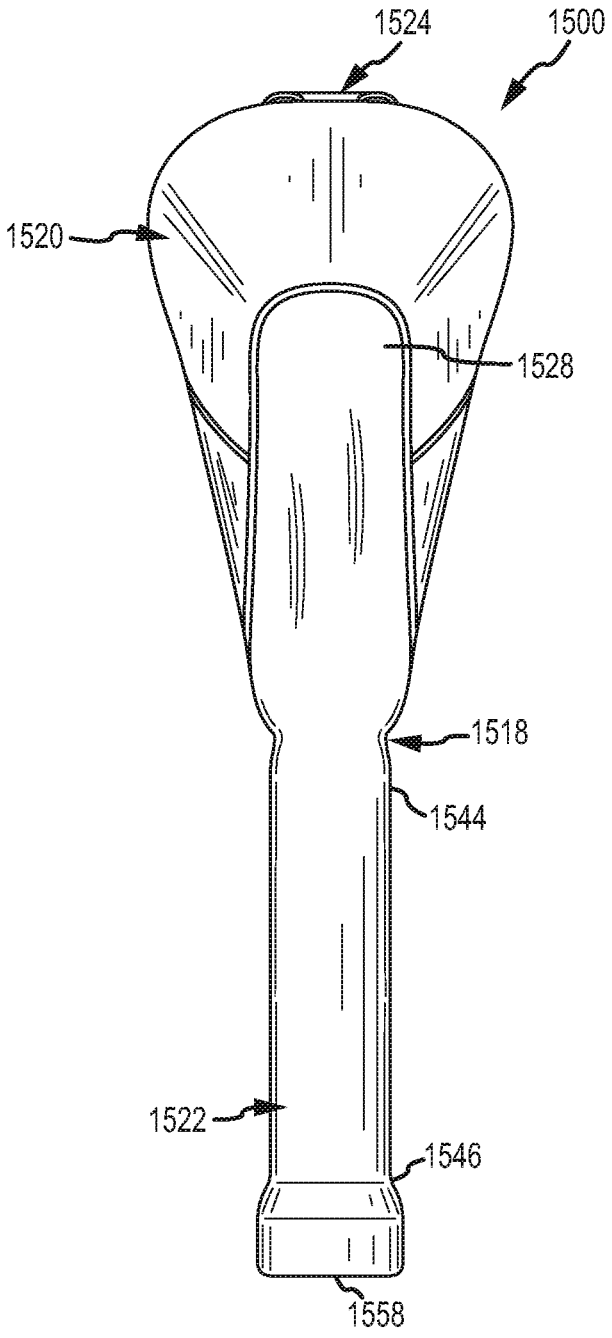
FIG. 31 is a front view of the golf club cover with the I-shaped pull strap.

As illustrated in FIGS. 30 and 33, in one embodiment similar to club head cover 100 an individual may remove the club head cover 1500 by inserting their hand, such as the individual's four fingers, through the channel 1560 defined between the pull strap 1524 and the top wall 1526 of the head portion 1520 in either the A or the B direction and then the individual applies an upward force against the pull strap 1524 in the C direction to remove the golf club cover 1500 from the golf clue head 1514 using one hand as the individual grasps the golf club 1512, such as the shaft 1516, with the other hand. In this manner, the individual can apply a much greater force against the first strap end 1540 of the pull strap 1524 because of the proportionately greater amount of material of the pull strap 1524 along the first strap end 1540 that is engaged to the head portion 1520 than the second strap end 1542 so that a much larger and even force may be applied to remove the club head cover 1500 from the golf club head 1514 than would otherwise occur with a pull strap of constant thin width. This even force being applied to the pull strap 1524 can also prevent the club head cover 1500 from catching along portions of the golf club 1512, which can inhibit removal of the club head cover 1500. As noted above, a pull strap having a constant thin width is incapable of applying as much force on the first head end 1536 of the club head cover 1500 to facilitate removal from the golf club head 1512. In addition, a pull strap of constant thin width cannot form a channel 1560 that is sufficiently configured to allow an individual's four fingers to contact sufficient.

Figure 39:
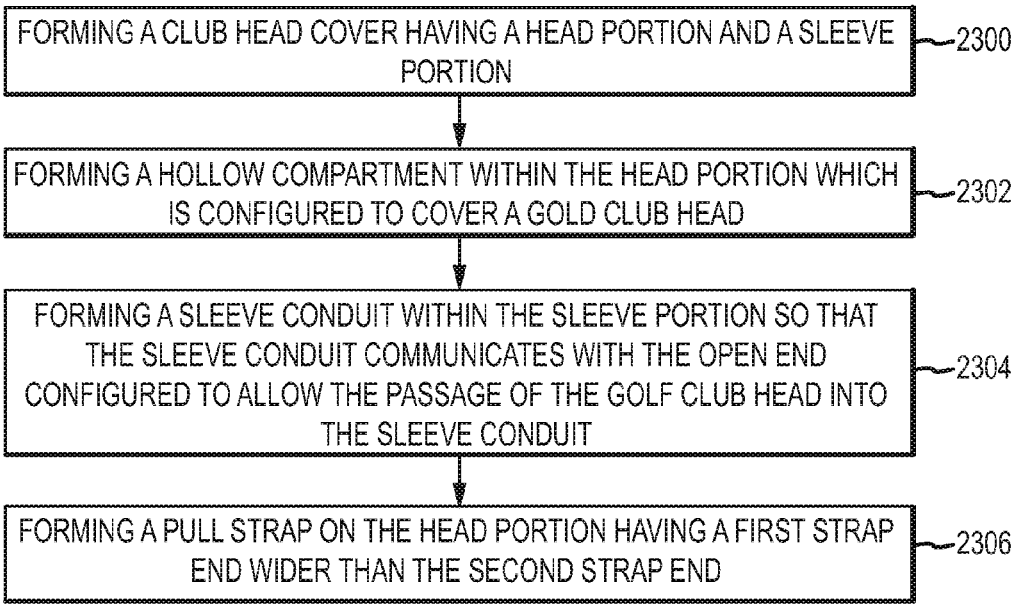
FIG. 39 is a flow chart illustrating a method for manufacturing the golf club cover with the I-shaped pull strap.

Referring to FIG. 39, a flow chart illustrates one method for manufacturing the club head cover 1500. At block 2300, a club head cover 1500 is formed having a head portion 1520 and a sleeve portion 1522. In some embodiments, the club head cover 1500 is formed from at least one of leather, neoprene, polyethylene, polyurethane, synthetic rubber, acrylonitrile butadiene styrene (ABS), plastic, or fabric material. At block 2302, a hollow compartment 1534 is formed within the head portion 1520 which is configured to cover the golf club head 1514. In one embodiment, the hollow compartment 1534 is wider at or proximate to the first head end 1536 than at or proximate the second head end 1538. At block 2304, a sleeve conduit 1562 is formed within the sleeve portion 1522 so that the sleeve conduit 1562 communicates with the open end 1558 configured to allow the passage of the golf club head 1514 into the sleeve conduit 1562. At block 2306, a pull strap 1524 is formed on the head portion 1520 having a first strap end 1540 wider than the second strap end 1542 of the pull strap 1524. In one embodiment, the pull strap is formed by sewing the pull strap 1524 to the head portion 1520. In some embodiments, forming the pull strap 1524 may include attaching the first strap end 1540 of the pull strap 1524 to the first head end 1536 and the second strap end 1542 of the pull strap 1524 to the second head end 1538. In addition, forming the pull strap 1524 further includes forming the channel 1562 to allow passage for an individual's hand to grasp the pull strap 1524.

Although FIGS. 1-39 illustrate club head covers 100, 200, 300, 400, 500, 600, 700, 800, 900, 1100, 1200, 1300, 1400, 1500, 1600, 1700, and 1800 having a particular symmetrical configuration, the apparatus and methods described herein may include other symmetrical or asymmetrical configurations. For example, the club head covers 100, 200, 300, 400, 500, 600, 700, 800, 900, 1100, 1200, 1300, 1400, 1500, 1600, 1700, and 1800 may have a circular configuration from the top view. In another example, the club head covers 100, 200, 300, 400, 500, 600, 700, 800, 900, 1100, 1200, 1300, 1400, 1500, 1600, 1700, and 1800 may have a more amorphous shape that "form fits" the golf club head, such as the driver-type golf club head illustrated in FIG. 6. Similarly, although the pull straps 124, 224, 324, 424, 524, 624, 724, 824, 924, 1124, 1224, 1324, 1424, 1524, 1624, 1724, 1824 and 1924 illustrated in FIGS. 1-39 have a particular symmetrical configuration, the apparatus and methods described herein may include other symmetrical or asymmetrical configurations. For example, the pull straps 124, 224, 324, 424, 524, 624, 724, 824, 924, 1124, 1224, 1324, 1424, 1524, 1624, 1724, 1824 and 1924 may have a generally tapered configuration from the top view. In another example, the pull straps 124, 224, 324, 424, 524, 624, 724, 824, 924, 1124, 1224, 1324, 1424, 1524, 1624, 1724, 1824 and 1924 may form a first side portion transverse to the first strap end (for example first strap end 140) and the second strap end (for example second strap 142) that has a symmetrical shape and an opposing second side end that has an asymmetrical shape. In a further example, the pull straps 124, 224, 324, 424, 524, 624, 724, 824, 924, 1124, 1224, 1324, 1424, 1524, 1624, 1724, 1824 and 1924 may form a first side portion that has a symmetrical shape and a second side portion that has a different symmetrical shape. In yet another example, the pull straps 124, 224, 324, 424, 524, 624, 724, 824, 924, 1124, 1224, 1324, 1424, 1524, 1624, 1724, 1824 and 1924 may also form a first side portion that has an asymmetrical shape and a second side portion that has a different asymmetrical shape.

The club head covers 100, 200, 300, 400, 500, 600, 700, 800, 900, 1100, 1200, 1300, 1400, 1500, 1600, 1700, and 1800 including the respective pull straps 124, 224, 324, 424, 524, 624, 724, 824, 924, 1124, 1224, 1324, 1424, 1524, 1624, 1724, 1824 and 1924 may be made from a variety of materials, such as leather, synthetic rubber, neoprene, polyethylene, polyurethane, acrylonitrile butadiene styrene (ABS), plastic, fabric material, or combinations thereof. For example, in some embodiments the pull straps 124, 224, 324, 424, 524, 624, 724, 824, 924, 1124, 1224, 1324, 1424, 1524, 1624, 1724, 1824 and 1924 may be made from synthetic rubber, while the remaining portions of the club head cover 100, 200, 300, 400, 500, 600, 700, 800, 900, 1100, 1200, 1300, 1400, 1500, 1600, 1700, and 1800 may be made from a different material, such as polyurethane. In other embodiments, the pull straps 124, 224, 324, 424, 524, 624, 724, 824, 924, 1124, 1224, 1324, 1424, 1524, 1624, 1724, 1824 and 1924 and the remaining portions of the club head covers 100, 200, 300, 400, 500, 600, 700, 800, 900, 1100, 1200, 1300, 1400, 1500, 1600, 1700, and 1800 may be made from the same material, such as neoprene or any of the other materials noted above. The apparatus, articles of manufacture, and methods described herein are not limited in this regard.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

The invention claimed is:

1. A head cover comprising:

a body comprising:

a head portion defining a hollow compartment configured to receive a golf club head having a toe portion and a heel portion, the head portion further defining a first head end and a second head end; and a hollow sleeve portion defining a sleeve conduit in communication with the hollow compartment, wherein the hollow sleeve portion is configured to cover a portion of a shaft connected to the golf club head; and a pull strap connected to the head portion of the body, the pull strap defining a first strap portion, a second strap portion, and a third strap portion each having respective ends connected to three respective different parts of the head portion, wherein the body and the pull strap define at least one channel configured to engage a portion of an individual's hand, wherein the at least one channel may be accessed by the individual's hand through three different openings defined between the head portion and the first strap portion, the second strap portion, and the third strap portion of the pull strap.

2. The head cover of claim 1, wherein the first head end is configured to engage a toe portion of the golf club head when the golf club head is disposed inside the hollow compartment whereas the second head end is configured to engage a heel portion of the golf club head when the golf club head is disposed inside the hollow compartment, and wherein the hollow compartment is wider at or proximate to the first head end than at or proximate the second head end.

3. The head cover of claim 1, wherein the first strap portion is wider than the second strap portion or the third strap portion.

4. The head cover of claim 1, wherein the first strap portion, the second strap portion, and the third strap portion collectively form a generally Y-shaped configuration.

5. The head cover of claim 1, wherein the first strap portion has a length longer than the second strap portion or the third strap portion.

6. The head cover of claim 1, wherein the pull strap may be grasped along at least one of the first strap portion, the second strap portion, and the third strap portion.

7. The head cover of claim 1, wherein the at least one channel is accessed by the individual's hand at three different orientations relative to the head portion.

8. A method comprising:

forming a body having a head portion in communication with a sleeve portion, the head portion comprises a first head end, a second head end, a third head end, a fourth head end, and a compartment configured to cover a golf club head;

forming a sleeve portion having a sleeve conduit in communication with the compartment, the sleeve conduit configured to allow passage of the golf club head into the compartment; and forming a pull strap connected to the head portion, the pull strap defining a first strap portion, a second strap portion, and a third strap portion each having respective ends connected to three respective different parts of the head portion, wherein the body and the pull strap define at least one channel to allow passage for a portion of an individual's hand, wherein the at least one channel may be accessed by the individual's hand through three different openings defined between the head portion and the first strap portion, the second strap portion, and the third strap portion of the pull strap.

9. The method of claim 8, wherein forming the pull strap comprises attaching the respective end of the first strap portion to the first head end, the respective end of the second strap portion to between the third head end and the second head end, and the respective end of the third strap portion to between the fourth head end and the second head end.

10. The method of claim 8, wherein forming the pull strap comprises configuring the first strap portion in transverse orientation relative to the second strap portion and the third strap portion.

11. The method of claim 8, wherein forming the pull strap comprises forming the first strap portion wider than at least one of the second strap portion or the third strap portion.

* * * * *